US010905185B2

(12) United States Patent
Hetzler et al.

(10) Patent No.: US 10,905,185 B2
(45) Date of Patent: Feb. 2, 2021

(54) SYSTEM FOR MITIGATING MUSCULOSKELETAL STRESSES FROM HEAD-RELATED MOMENTS EXERTED ON A PERSON

(71) Applicant: THUMBPRINT SOLUTIONS INC., Whitchurch-Stouffville (CA)

(72) Inventors: Markus Hetzler, Whitchurh-Stouffville (CA); Steven Fischer, Waterloo (CA); Joan Stevenson, Kingston (CA); Susan Reid, Kingston (CA)

(73) Assignee: THUMBPRINT SOLUTIONS, INC., Whitchurch-Stouffville (CA)

( * ) Notice: Subject to any disclaimer, the term of this patent is extended or adjusted under 35 U.S.C. 154(b) by 545 days.

(21) Appl. No.: 15/510,042

(22) PCT Filed: Sep. 10, 2015

(86) PCT No.: PCT/CA2015/050877

§ 371 (c)(1),
(2) Date: Mar. 9, 2017

(87) PCT Pub. No.: WO2016/037284

PCT Pub. Date: Mar. 17, 2016

(65) Prior Publication Data

US 2017/0245576 A1 Aug. 31, 2017

Related U.S. Application Data

(60) Provisional application No. 62/048,650, filed on Sep. 10, 2014.

(51) Int. Cl.
*A42B 3/00* (2006.01)
*A42B 3/04* (2006.01)

(52) U.S. Cl.
CPC ..... *A42B 3/0473* (2013.01); *A42B 3/0406* (2013.01)

(58) Field of Classification Search
CPC ..... A42B 3/0473; A41D 13/0512; A63B 71/1291
See application file for complete search history.

(56) References Cited

U.S. PATENT DOCUMENTS 3,873,996 A * 4/1975 Varteressian ..... A42B 3/0473 2/421
4,664,341 A * 5/1987 Cummings ..... B64D 25/02 128/857

(Continued)

FOREIGN PATENT DOCUMENTS

CA 2117384 A1 7/1993

OTHER PUBLICATIONS

PCT/CA2015/050877, International Search Report, dated Mar. 17, 2016.

*Primary Examiner* — Richale L Quinn
(74) *Attorney, Agent, or Firm* — Millman IP Inc.

(57) ABSTRACT

In an aspect, a stress mitigation system is provided for mitigating stresses in a wearer of a headgear configured to apply a load on the wearer that is offset from a center of gravity of the wearer's head to apply a first torque in a first direction on the wearer's head. The system includes a track, a shuttle, and a flexible elongate connector. The track is mounted to either the headgear or a bodywear member and extends generally laterally. The shuttle is movable along the track. The connector is configured to connect between the shuttle and the other of the headgear and the bodywear member. The connector applies a second torque on the headgear in a second direction that is generally opposite to the first direction. When the wearer's head pivots, the shuttle (Continued)

is movable laterally along the track to maintain the connector in a substantially vertical orientation.

15 Claims, 32 Drawing Sheets

(56) References Cited

U.S. PATENT DOCUMENTS 4,967,985 A * 11/1990 Deakin ..... A42B 3/0473 244/121
5,242,377 A * 9/1993 Boughner ..... A61F 5/055 602/17
5,267,708 A * 12/1993 Monson ..... B64D 25/02 244/121
5,371,905 A * 12/1994 Keim ..... A42B 3/0473 2/413
5,581,816 A * 12/1996 Davis ..... A42B 3/0473 2/410
6,810,535 B1 * 11/2004 Moloney ..... A42B 3/0473 2/411
7,430,767 B2 * 10/2008 Nagely ..... A42B 3/0473 2/425
9,351,529 B1 * 5/2016 Ashline ..... A42B 3/0473
9,603,404 B2 * 3/2017 Pocatko ..... A42B 3/0473
9,603,405 B2 * 3/2017 Blecherman ..... A42B 3/0473
9,826,792 B2 * 11/2017 Dowd ..... A42B 3/185
9,867,413 B2 * 1/2018 Blecherman ..... A42B 3/0473
10,292,446 B2 * 5/2019 Jinkins ..... A42B 3/0473
2001/0002087 A1 * 5/2001 Townsend ..... A42B 3/0473 280/801.1
2006/0260027 A1 * 11/2006 Rhodes ..... A42B 3/0473 2/421
2008/0209617 A1 * 9/2008 Castillo ..... A41D 13/0512 2/461
2008/0313791 A1 * 12/2008 Nagely ..... A42B 3/0473 2/425
2014/0053324 A1 * 2/2014 Jackson ..... A42B 3/0473 2/425
2014/0283287 A1 * 9/2014 Pocatko ..... A42B 3/0473 2/421

* cited by examiner

SYSTEM FOR MITIGATING MUSCULOSKELETAL STRESSES FROM HEAD-RELATED MOMENTS EXERTED ON A PERSON

CROSS-REFERENCE TO RELATED APPLICATIONS

This application claims the benefit of U.S. Provisional Application No. 62/048,650, filed Sep. 10, 2014, the contents of which are incorporated herein by reference in their entirety.

FIELD OF INVENTION

This disclosure relates generally to the field of mitigating stress on the neck muscles of a person, and more particularly to systems for mitigating stresses on wearers of headgear with weighted items that exert moments on the head of the wearer.

BACKGROUND OF INVENTION

It is generally known that certain activities involve postures or muscle control requirements that can result in stress in the neck muscles of a person. For example, occupations (or pastimes) such as gardening or baking can involve a head-down posture sometimes for a long period of time, which cause unbalanced forces on the neck of the person carrying out the activity. These unbalanced forces result in significant stresses in the neck muscles for the person.

Other activities entail the wearing of headgear in which one or more weighted items that form part of the headgear are offset from the center of gravity of the headgear and by extension, offset from the centre of gravity or optimal balance point of the head-neck complex of the person. For example, in the armed forces, soldiers regularly wear helmets with night vision goggles on them. When the wearer is standing upright, the weight of the night vision goggles causes a torque to be applied that urges the head of the wearer to tip forward. As a result, wearing a helmet with night vision goggles can result in significant short-duration as well as cumulative stresses on the neck muscles of the wearer. A common solution for this problem is to add a counterweight to the rear of the helmet to offset the torque applied by the night vision goggles.

There are several problems that result from the use of a counterweight, however. One problem is that, while the counterweight reduces the net torque that is applied to the wearer's head, the addition of the counterweight adds to the amount of weight that the wearer must bear. This adds to the stress on the neck muscles for a wearer who is standing upright. However, certain armed forces personnel, flight engineers on military helicopters for example, spend significant amounts of time lying down on the floor of the helicopter looking down towards the ground during flight. When the wearer is lying down, the added weight of the counterweight adds significantly to the net torque applied to the wearer's head, since both the counterweight and the goggles apply a torque urging the wearer's head downwards. Furthermore, the counterweight adds to the amount of inertia that is associated with the helmet. As a result, when the wearer turns their head to look to one side or the other, the amount of inertia resisting the rotary head motion by the wearer is larger than it would be without the counterweight. Similar effects are noted with variations of perceived gravitational forces exerted on the system, such as the increase in apparent weight experienced when an aircraft in flight is in a steep coordinated turn. Thus, while the counterweight is helpful in one sense (to neutralize the torque applied by the goggles on an upright wearer), it can increase the stress on the wearer's neck muscles in several other situations.

It would be beneficial to provide a system for mitigating stresses on a wearer of headgear or that reduces the stresses in the neck muscles of a person, more generally.

SUMMARY

In an aspect, a stress mitigation system is provided for mitigating stresses in a wearer of a headgear. The headgear is configured to apply a load on the wearer that is offset from a center of gravity of a head of the wearer so as to apply a first torque in a first torque direction on the head of the wearer. The stress mitigation system includes a track, a shuttle, and a flexible elongate connector. The track is mounted to one of the headgear and a bodywear member configured for wearing on a body of the wearer. The track extends generally laterally. The shuttle is movable along the track. The flexible elongate connector is configured to connect between the shuttle and the other of the headgear and the bodywear member. When the wearer is upright, the flexible elongate connector is biased so as to apply a second torque on the headgear in a second torque direction that is generally opposite to the first torque direction. When the head of the wearer pivots about a generally vertical axis, the shuttle is movable laterally along the track so as to maintain the flexible elongate connector in a substantially vertical orientation.

In another aspect, a stress mitigation system is provided for mitigating stresses in a wearer of a headgear. The headgear is configured to apply a load on the wearer that is offset from a center of gravity of a head of the wearer so as to apply a first torque in a first torque direction on the head of the wearer. The stress mitigation system includes a flexible elongate connector arrangement that is connectable between the headgear and a bodywear member configured for wearing on a body of the wearer. When the wearer is upright, the flexible elongate connector arrangement is biased so as to exert a connector arrangement force in a connector arrangement force direction that is generally opposite to the load force direction on the headgear, and so as to exert a second torque in a second torque direction that is generally opposite to the first torque direction on the headgear. The flexible elongate connector arrangement is positioned on first and second lateral sides of the headgear only.

In another aspect, a stress mitigation system is provided for mitigating stresses in a wearer of a headgear. The headgear is configured to apply a load on the wearer that is offset from a center of gravity of a head of the wearer so as to apply a first torque in a first torque direction on the head of the wearer. The stress mitigation system includes a first force transfer connector segment and a second force transfer connector segment, and a tensioning device. Each force transfer connector segment has a first end and a second end. The first ends are mounted to one of the headgear and the bodywear member and the second ends are mounted to the other of the headgear and the bodywear member. The first ends are laterally inboard from the second ends and are vertically spaced from the second ends such that, during pivoting movement of the head of the wearer in a first pivot direction about a vertical axis, the first force transfer connector segment changes orientation towards a vertical orientation and the second force transfer connector segment changes orientation towards a horizontal orientation, and during pivoting movement of the head of the wearer in a second pivot direction about the vertical axis, the first force transfer connector segment changes orientation towards the horizontal orientation and the second force transfer connector segment changes orientation towards the vertical orientation. The tensioning device is configured to reduce tension in any of the first and second force transfer connector segments that changes orientation towards the horizontal orientation and to increase tension in any of the first and second force transfer connector segments that changes orientation towards the vertical orientation.

In another aspect, a stress mitigation system is provided for mitigating stresses in a wearer of a headgear. The headgear is configured to apply a load on the wearer that is offset from a center of gravity of a head of the wearer so as to apply a first torque in a first torque direction on the head of the wearer. The stress mitigation system includes a flexible elongate connector and a take-up member that is configured for taking up and paying out the flexible elongate member. The flexible elongate connector is configured to connect between the headgear and the bodywear member. The take-up member is configured to take up and pay out the flexible elongate connector and is biased so as to apply tension to the flexible elongate connector. When the wearer is upright, the tension in the flexible elongate connector applies a second torque on the headgear in a second torque direction that is generally opposite to the first torque direction.

An example of a suitable take-up member is a spool. The spool is connected to receive one end of the flexible elongate connector thereon and is biased in a direction so as to apply tension to the flexible elongate connector.

In another aspect, a stress mitigation system is provided for mitigating stresses in neck muscles of a person, comprising: a headgear, a track, a shuttle, and a flexible elongate connector. The headgear is configured to mount to the head of the person. The track is mounted to one of the headgear and a bodywear member that is configured for wearing on a body of the person. The track extends generally laterally. The shuttle is movable along the track. The flexible elongate connector is configured to connect between the shuttle and the other of the headgear and the bodywear member. When the person is in a selected position, the flexible elongate connector is biased so as to apply a torque on the headgear in a selected torque direction. When the head of the person pivots about a generally longitudinal axis, the shuttle is movable laterally along the track so as to maintain the flexible elongate connector in a substantially longitudinal orientation.

In another aspect, a stress mitigation system is provided for mitigating stresses in neck muscles of a person, comprising: a headgear, a flexible elongate connector and a take-up member that is configured for taking up and paying out the flexible elongate member. The headgear is configured to mount to the head of the person. The flexible elongate connector is configured to connect between the headgear and the bodywear member. The take-up member is connected to take up and pay out the flexible elongate connector and is biased so as to apply tension to the flexible elongate connector. When the person is in a selected position, the flexible elongate connector is biased so as to apply a torque on the headgear in a selected torque direction.

BRIEF DESCRIPTION OF THE DRAWINGS

The foregoing and other aspects of the disclosure will be more readily appreciated by reference to the accompanying drawings, wherein.

DETAILED DESCRIPTION OF EMBODIMENTS

Figure 1:
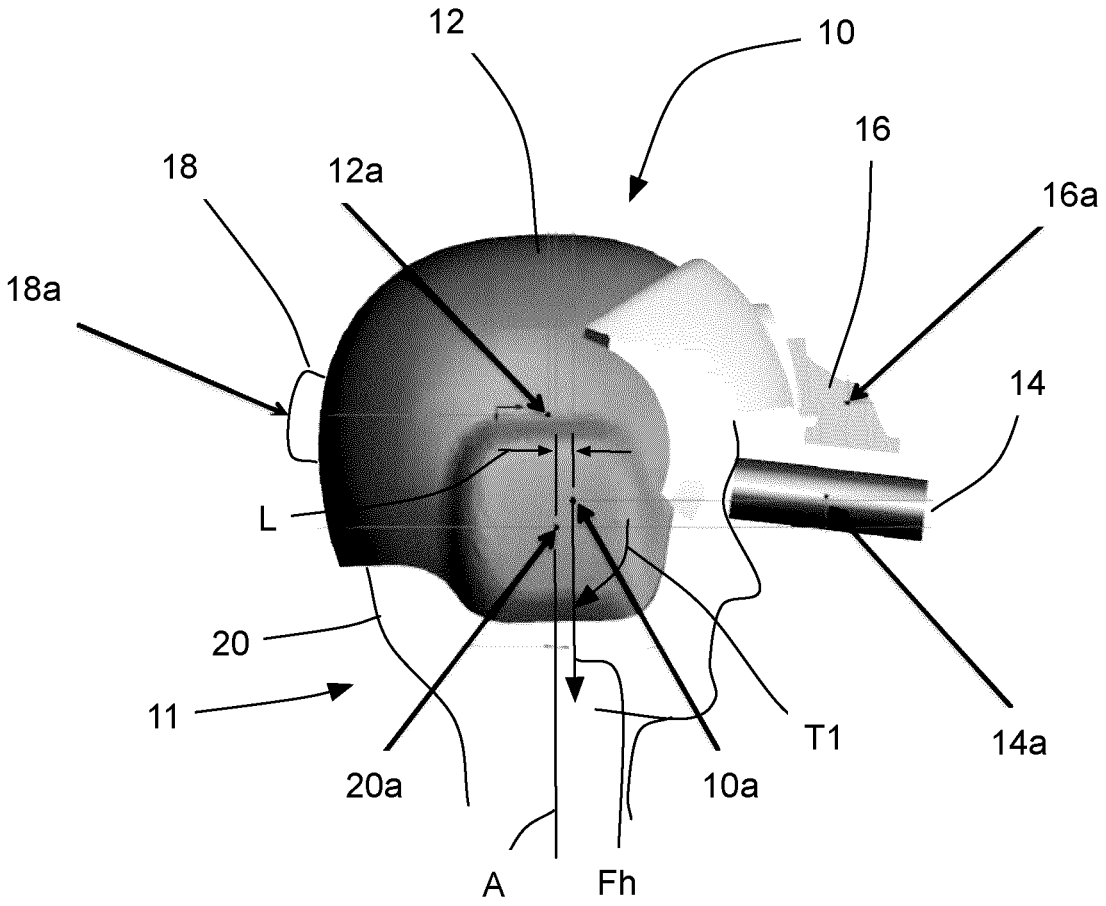
FIG. 1 is an elevation view of a typical headgear illustrating the centers of gravity of various elements that make up the headgear.

Reference is made to FIG. 1, which shows a headgear 10 being worn by a wearer 11. The headgear 10 includes a helmet 12, having a helmet center of gravity 12*a*, a pair of night vision goggles 14, having a night vision goggles center of gravity 14*a*, a mounting structure 16 for the night vision goggles 14 having its own center of gravity 16*a*, and a battery pack 18 for providing power to the night vision goggles 14, having its own center of gravity 18*a*. The wearer 11 has a head 20, which has a center of gravity 20*a*. When all of the components are taken into account, it can be seen that the overall center of gravity of the headgear 10 (shown at 10*a*) is not coincident with the center of gravity 20*a* of the wearer's head 20. As a result, the headgear 10 is configured to apply a load Fh on the wearer 11 that is offset from (in this example, forward of) the center of gravity 20*a* of the head 20 of the wearer 11 so as to apply a first torque T1 (which is equal to the load Fh times the offset distance L between the center of gravity 10*a* of the headgear 10 and the center of gravity 20*a* of the head 20) in a first torque direction (which is clockwise in the view shown in FIG. 1). The first torque T1 urges the wearer's head 20 to tip forwards. Furthermore, several elements of the headgear 10, such as the battery pack 18, the night vision goggles 14 and the mounting 16, constitute significant masses that are positioned relatively far from the axis A about which the wearer's head 20 rotates when the wearer 11 turns his/her head in any direction (e.g. when the wearer looks to the left or to the right, or pivots his/her head up or down). Thus, these masses contribute significantly to the polar moment of inertia of the headgear 10.

Figure 2:
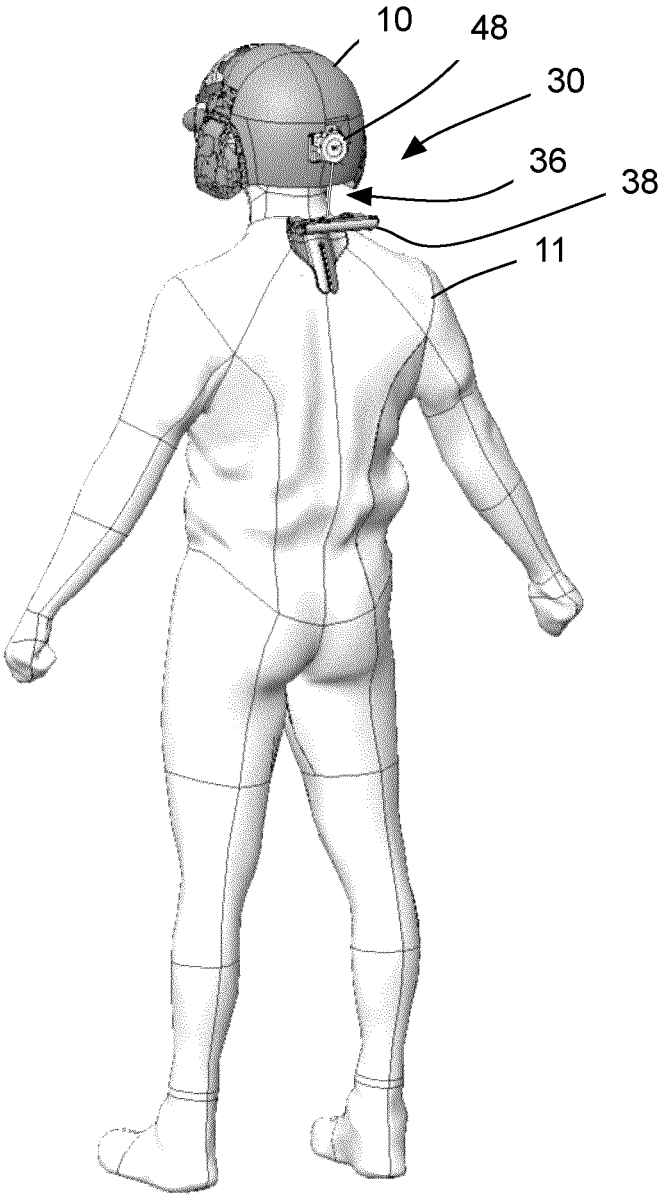
FIG. 2 is a perspective view of a wearer with a headgear and a stress mitigation system for mitigating stresses in the wearer in accordance with an embodiment of the present disclosure.

Instead of adding a counterweight to the rear of the helmet 12 to adjust the center of gravity 10*a* of the headgear 10 towards the center of gravity 20*a* of the wearer's head 20, a system 30 for mitigating stresses on the wearer 11 in accordance with an embodiment of the present disclosure is shown in FIG. 2. The system 30 may be referred to as a stress mitigation system 30.

Figure 3:
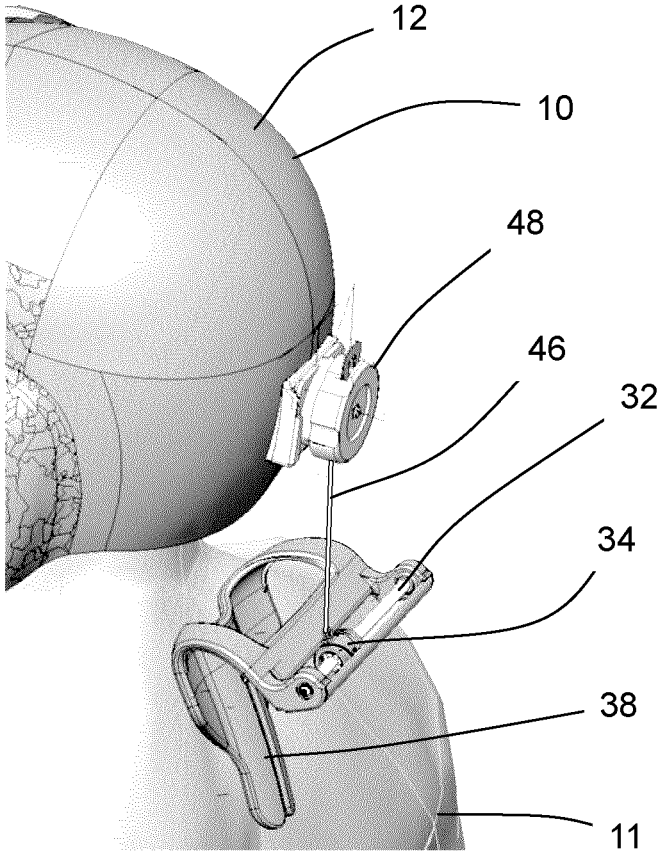
FIG. 3 is a magnified perspective view of the stress mitigation system shown in FIG. 2.

Referring to FIG. 3, the stress mitigation system 30 includes a track 32, a shuttle 34 and a flexible elongate connector arrangement 36. The track 32 is mounted to one of the headgear 10 and a bodywear member shown at 38, and the flexible elongate connector arrangement 36 includes a flexible elongate connector 46 that connects between the shuttle 34 and the other of the other of the headgear 10 and the bodywear member 38. In the example shown in FIG. 3, the track 32 with the shuttle 34 mounted thereon, is mounted to the bodywear member 38, and the flexible elongate connector 46 connects between the shuttle 34 and the headgear 10.

Figure 4:
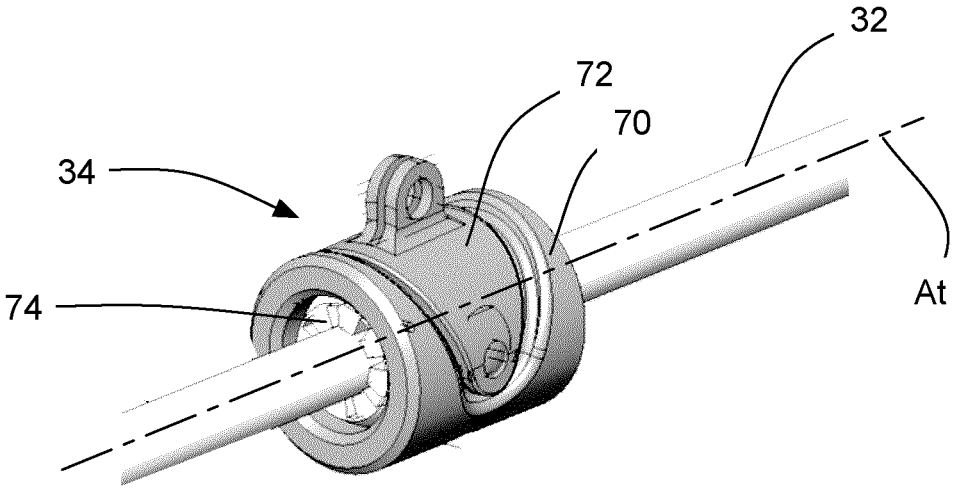
FIG. 4 is a highly magnified perspective view of a shuttle and track that form part of the stress mitigation system shown in FIG. 2.

The track 32 may be made from any suitable material such as a metal such as aluminum, or it may be made from a suitably strong and stiff, low friction polymeric material. The track 32 extends generally laterally. As can be seen in FIG. 4, the track 32 may have a circular cross-sectional shape and may extend directly laterally, with no curvature to its path. The shuttle 34 may also include suitable elements such as linear bearings with recirculating balls.

The bodywear member 38 is configured for wearing on the body of the wearer 11. For example, the bodywear member 38 may include a plate that fits into and projects from a pocket provided on the back of a garment for the upper torso of the wearer 11. Alternatively the bodywear member 38 may be mounted to the back of a garment for the upper torso by rivets, hook-and-loop material, stitching or the like. Alternatively any other suitable mounting for the bodywear member 38 may be provided.

The shuttle 34 is movable along the track 32. The shuttle 34 may be movable by any suitable means. For example, in the embodiment shown in FIG. 4, the shuttle 34 includes a shuttle body 70 that holds a bushing 74 with a circular pass-through aperture 76 for mounting the shuttle 34 to the track 32. By providing the track 32 with a circular cross-sectional shape, the shuttle 34 can freely rotate about the track axis as needed. The track axis is shown at At in FIG. 4.

The flexible elongate connector arrangement 36 is configured to connect the shuttle 34 to the other of the headgear 10 and the bodywear member 38. In the example shown in FIG. 3, the flexible elongate connector arrangement 36 connects the shuttle 34 to the headgear 10. Aside from the flexible elongate connector 46, in the example shown in FIG. 3, the flexible elongate connector arrangement 36 further includes a tensioning device 48 that maintains a selected tension on the flexible elongate connector 46. The flexible elongate connector 36 may be any suitable type of flexible elongate connector such as a cable, a string or a ribbon. In the examples shown herein, the flexible elongate connector 46 is a cable, and may be referred to as a cable for convenience and readability. It will be understood however, that any suitable flexible elongate connector could alternatively be used in embodiments where a cable is described.

Figure 14A:
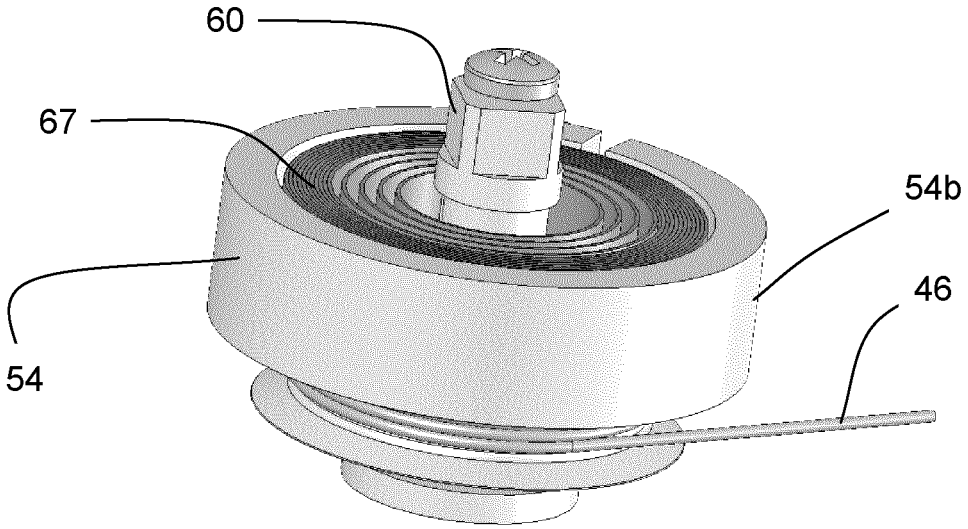
FIGS. 14*a* and 14*b* are perspective views of a portion of the tension adjustment device shown in FIG. 11 with further components removed to show a cable that is tensioned using the tension adjustment device.
Figure 14B:
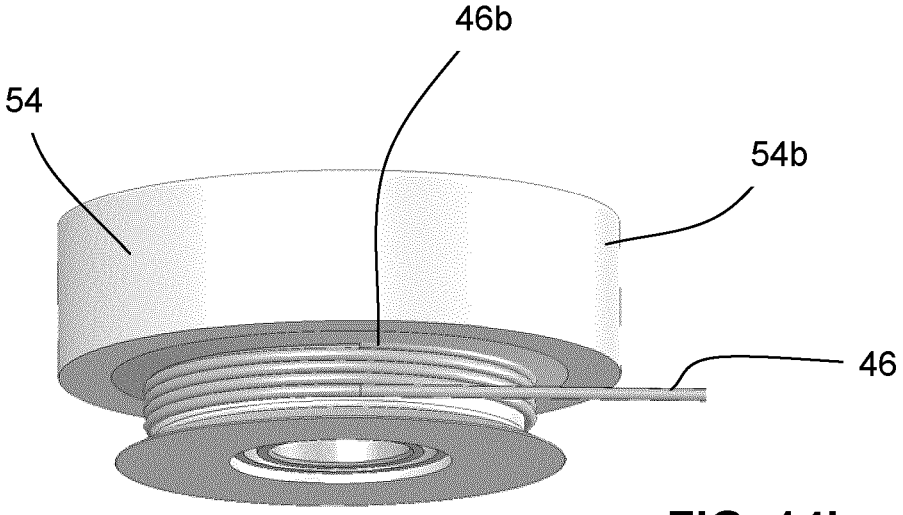
Figure 15:
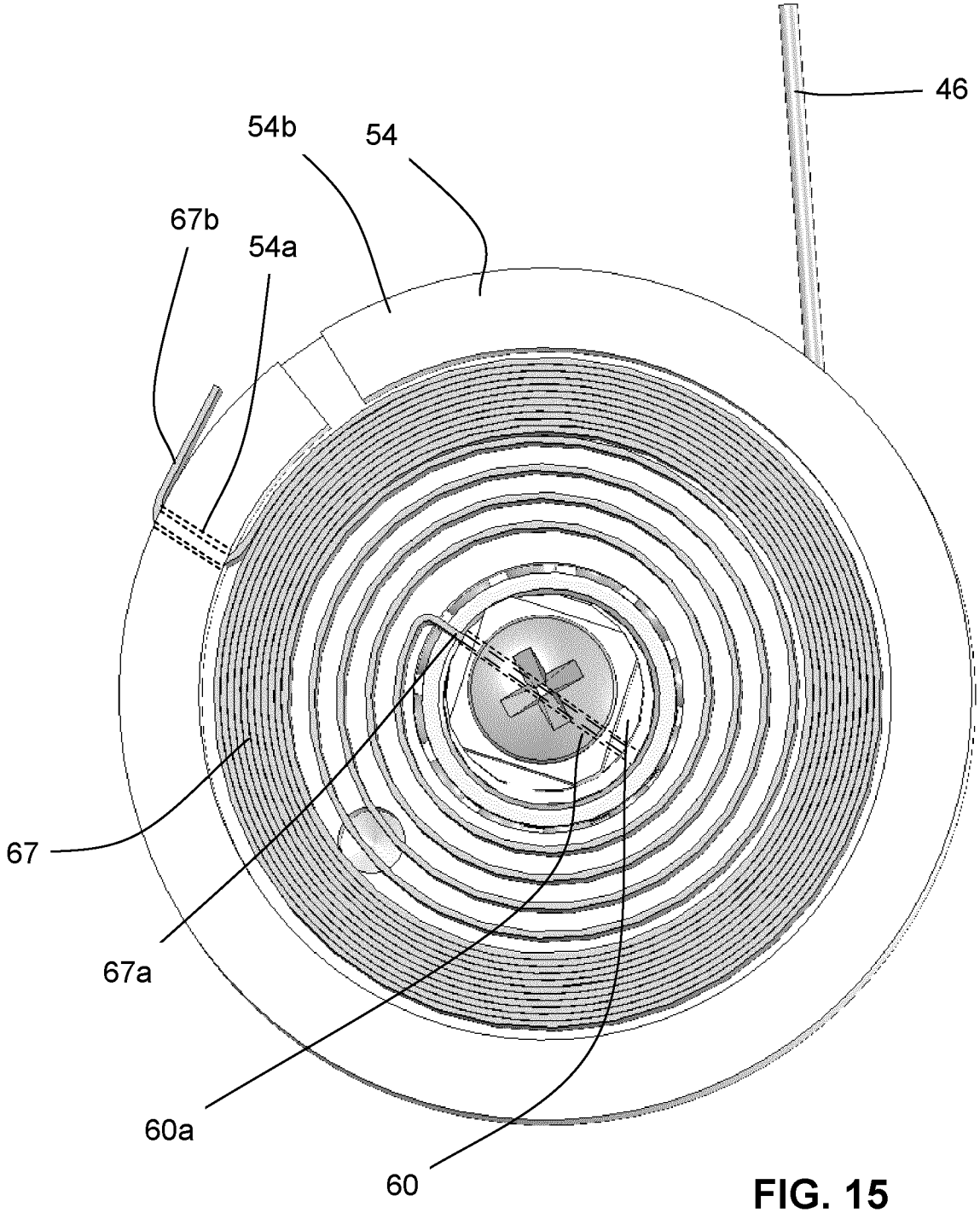
FIG. 15 is a plan view of the portion of the tension adjustment device shown in FIG. 14.

The cable 46 has a first end 46*a* that is connected to the shuttle 34, and a second end 46*b* (FIG. 14*b*) that is connected to a take-up member 54 that is part of the tensioning device 48.

Figure 13A:
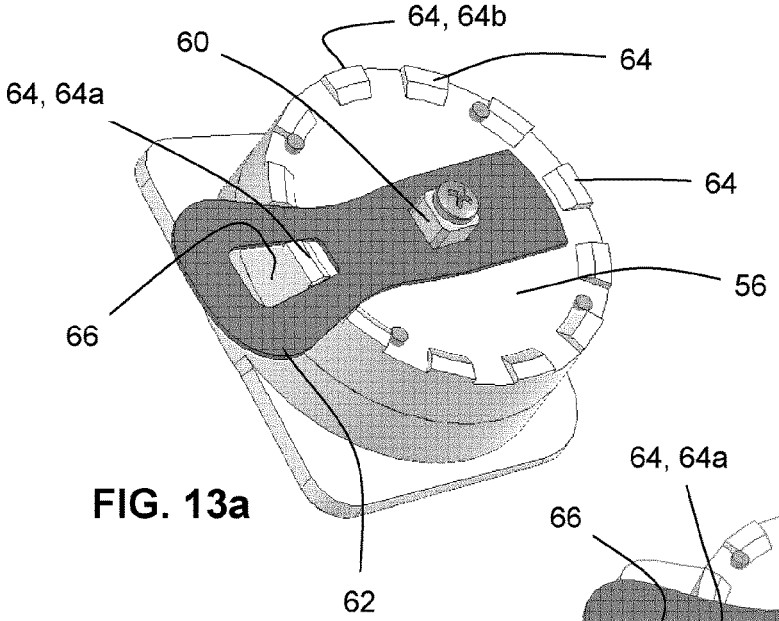
FIGS. 13*a*-13*c* are perspective views of a portion of the tension adjustment device shown in FIG. 11 with some components removed, illustrating some steps involved in the adjustment of the tension adjustment device.
Figure 13B:
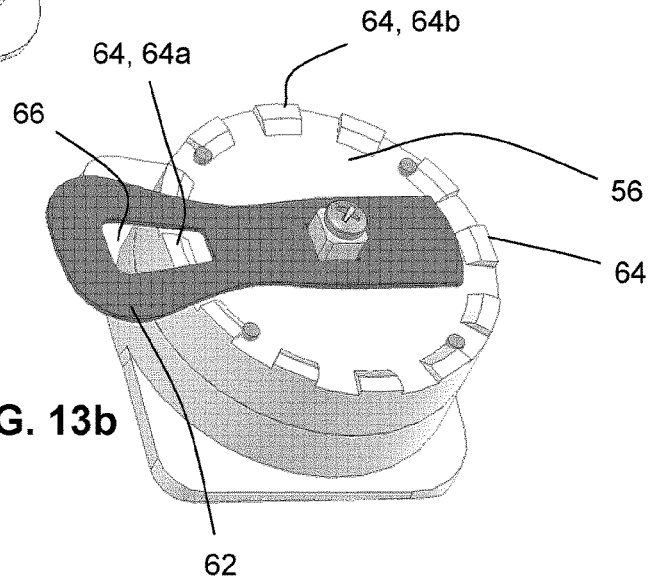
Figure 13C:
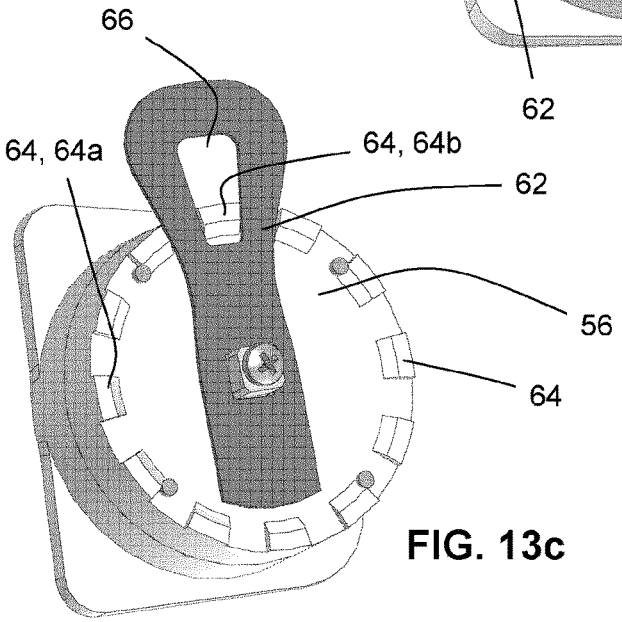

The tensioning device 48 further includes a tensioning device housing 56, and a flexible elongate connector biasing member 58. The tensioning device housing 56 is a fixed member that acts as a base for holding the other components of the tensioning device 48. A shaft 60 (FIGS. 13*a* and 14*a*) is rotatably movable relative to the housing 56 but is held in a selected position by an adjustable locking member 62 that extends from the shaft 60 is selectively engageable with a plurality of housing features 64 on the housing 56 that are arranged at regularly spaced positions about the perimeter of the housing 56. The housing features 64 may be, for example, projections that are each engageable with an aperture 66 on the locking member 62. In FIG. 13*a*, the locking member 62 holds the shaft 60 in a first angular position by mating with a first housing feature 64*a*. The locking member 62 is sufficiently flexible so as to be lifted off of the first housing feature 64*a* that it is engaged with (FIG. 13*b*), thereby permitting rotation of the locking member 62 and the shaft 60 to a new, second angular position for locking with a second housing feature 64*b* (FIG. 13*c*), so as to lock the shaft 60 in that second angular position.

The take-up member 54 may be a spool and may be referred to in as spool 54 in reference to at least some of the examples shown in the figures. Any other suitable take-up member may be used alternatively, however.

The flexible elongate connector biasing member 58 may be any suitable type of biasing member, such as, for example, a clock spring 67, or some other spring or mechanism arrangement with a relatively low, and relatively constant effective force throughout the working range of the stress mitigation system. The clock spring 67 has a first end 67*a* that is connected to the shaft 60 (e.g. by engagement with a radial slot 60*a* in the shaft 60), and a second end 67*b* that engages an aperture 54*a* in a wall 54*b* of the spool 54. As a result, the clock spring 67 biases the spool 54 in a direction to wind up the cable 46 so as to apply a selected tension to the cable 46.

A hand-knob 68 (FIGS. 13*a* and 13*b*) may be connected to the shaft 60 (e.g. by virtue of a square or other polygonal aperture in the hand-knob 68 that fits a square or other polygonal profile on the shaft 60). The hand-knob 68 facilitates rotary movement of the shaft 60 and the locking member 62 by the wearer 11 when the locking member 62 is disengaged from the projections 64. As a result, the hand-knob 68 and the adjustable locking member 62 provide the ability for the wearer 11 to adjust the tension provided by the tensioning device 48. It will be understood that the hand-knob 68 is optional, however, and that the shaft 60 could be rotated by any suitable means such as by manually turning the locking member 62 once it is disengaged from the projections 64.

If it is desired to change the amount of tension present in the cable 46, the wearer 11 may lift the locking member 62 off the projection 64 that it is engaged with and can then turn the hand-knob 68, while keeping the locking member 62 raised, to a new position, thereby changing the amount of flex in the clock spring 67, which in turn changes the spring force applied by it to the spool 54 and thus to the cable 46. Once the selected tension is reached, the wearer can lower the locking member 62 onto a suitable projection 64 nearby so as to fix the rotational position of the shaft 60. In embodiments where the biasing member 58 is a clock spring 67, the tension in the cable 46 remains relatively constant over the range of angular movement that is incurred by the spool 54 during use of the system 30.

Figure 7:
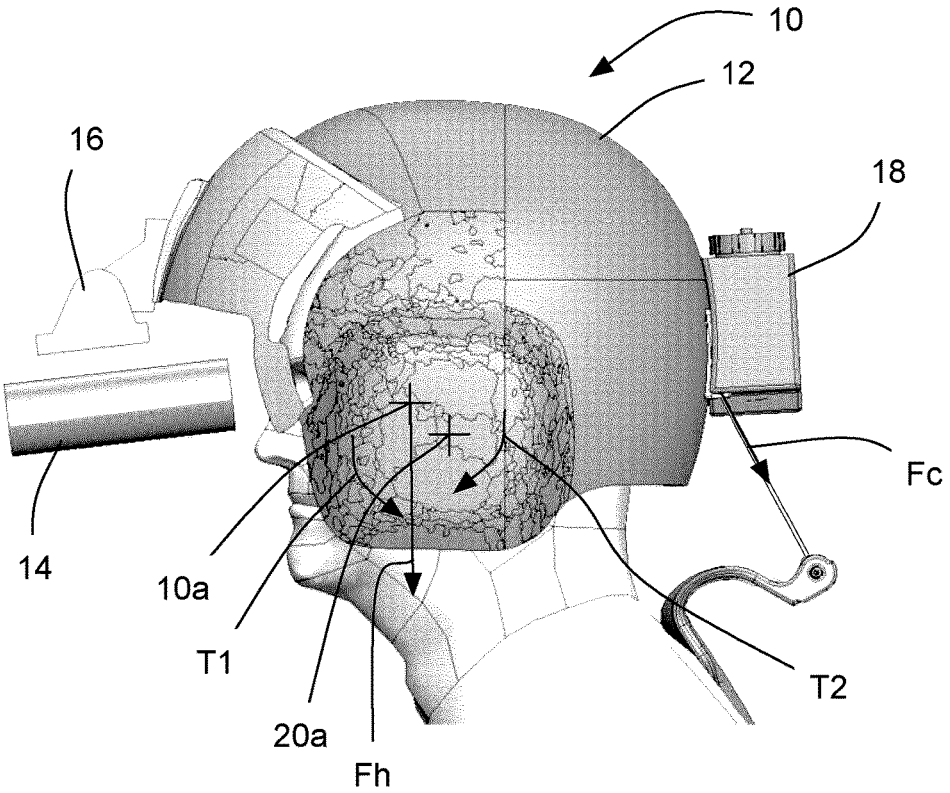
FIG. 7 is a side view of the forces acting on the wearer when using the system shown in FIG. 2.

By using the tensioning device 48 to wind the cable 46 onto the spool 54 and to apply tension to the cable 46 (shown as Fc in FIG. 7), the cable 46 (and therefore the flexible elongate connector arrangement 36) applies a second torque T2 on the headgear 10 that is in a second torque direction that is generally opposite to the first torque direction when the wearer 11 is standing upright, as can be seen in FIG. 7. As a result, the wearer 11 does not have to use their neck muscles to apply a torque to counteract the entirety of the first torque T1. Because the tensioning device 48 is capable of adjustment of the tension it applies, the wearer 11 can adjust it so that the torque T2 substantially cancels the torque T1. In the event that the wearer 11 adds weight to the front of the headgear (e.g. if the wearer 11 replaces their night vision goggles with another set of night vision goggles that are weighted differently), the tensioning device 48 can be adjusted to a different tension so that it again substantially cancels the torque applied by the headgear with the new goggles.

It will be noted that the stress mitigation system 30 counteracts the torque T1 without the use of a counterweight, as was proposed in the prior art. By avoiding the use of a counterweight, the system 30 reduces the amount of stress incurred by the wearer 11 in order to carry the weight of the headgear 10. Furthermore, by avoiding the use of a counterweight the system 30 reduces the amount of rotational inertia that exists as compared to a system that includes a counterweight.

By providing the track 32 and the shuttle 34, the system 30 can accommodate the turning of the wearer's head since the shuttle 34 is movable laterally along the track 32 so as to maintain the cable 46 in a substantially vertical orientation, which means that the force Fc in the cable 46 remains substantially vertical even when the wearer's head is turned, so as to counteract the torque T1 from the weighted items such as the night vision goggles, without applying a horizontal torque that urges the wearer's head back towards a center position or providing a rolling moment on the wearer's head. By contrast, if the cable were simply tethered to a fixed point on the back of the wearer, as the wearer would turn their head, the cable would become more and more angled horizontally at which point the tension in the cable would apply a progressively increasing horizontal torque on the wearer's head, resisting the turning of the wearer's head.

The terms 'horizontal' and 'vertical' as used herein are based on the assumption that the wearer 11 is standing upright and therefore turning his or her head about a vertical axis. It is understood that the device is nonetheless applicable in situations where the wearer 11 is lying down, such as when the wearer 11 is a flight engineer on a military helicopter as described above. In such situations, the term 'vertical' is intended to mean 'longitudinal' (i.e. generally parallel to a longitudinal axis of the wearer), and 'horizontal' is intended to mean 'lateral' (i.e. generally parallel to a lateral axis of the wearer). It will be understood that, some embodiments, the stress mitigation system is capable of at least partially counteracting moments that are applied to the wearer's head via the force exerted through the cable 46. It will be further understood that this force need not be exerted in a strictly vertical direction; the force may be exerted in a direction that is off of vertical while still being offset from the centre of gravity of the head of the wearer so as to provide a counterbalancing torque to the torque applied by the headgear on the wearer's head.

Figure 5:
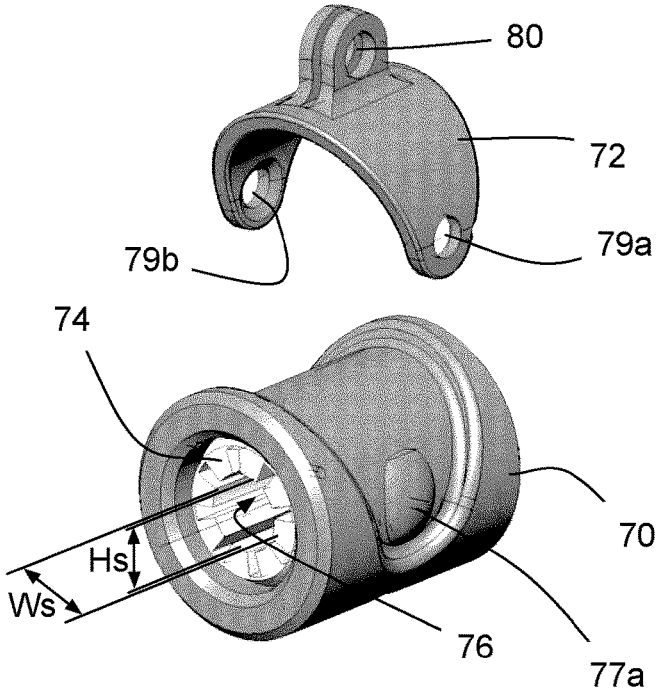
FIG. 5 is an exploded perspective view of the shuttle shown in FIG. 4.

Referring to FIGS. 4-6*a*, the shuttle 34 includes a shuttle body 70 and optionally includes a shuttle pivot member 72 that is pivotably connected to the shuttle body 70. The shuttle body 70 may include any suitable means for permitting movement of the shuttle 34 along the track 32. For example, the shuttle body 70 may include a polymer bushing 74 that slidably supports the shuttle 34 on the track 32. The bushing 74 defines a pass-through aperture 76 for receiving the track 32. The pass-through aperture 76 has a length Ls (FIG. 6), a height Hs (FIG. 5) and a width Ws (FIG. 5), as shown in FIG. 5. It will be understood that in embodiments in which the track 32 is a cylindrical rod, as is the case in the example shown in FIGS. 4-6*a*, the height Hs and the width Ws are both the same and both represent the diameter of the aperture 76. A center of the aperture 76 (i.e. a point that is positioned at the midpoint of the length Ls, the midpoint of the height Hs and the midpoint width Ws) is shown at C in FIG. 6*a*.

Figure 6:
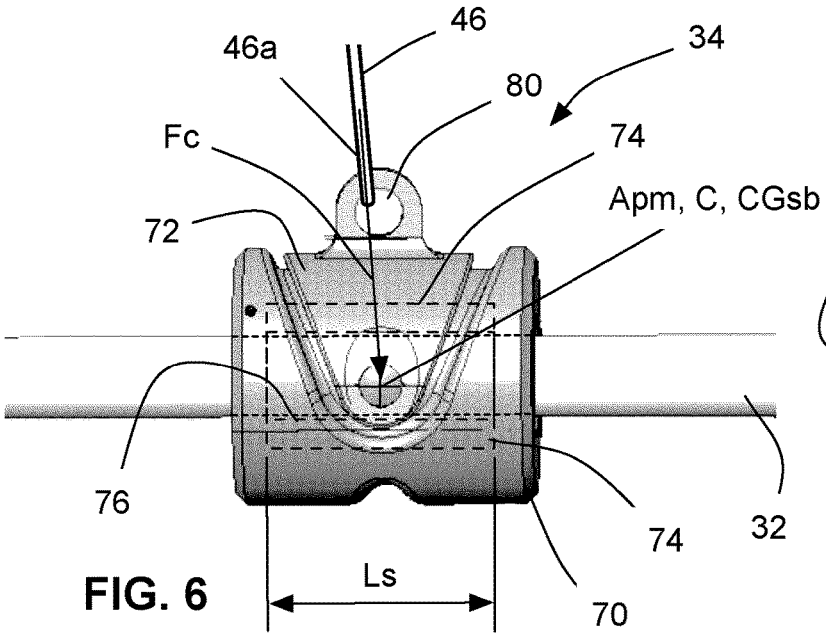
FIG. 6 is an elevation view of the shuttle illustrating the forces acting on it when the wearer of the system turns his/her head.
Figure 6A:
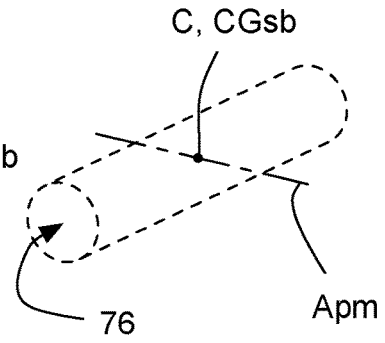
FIG. 6*a* is a perspective view of an aperture through the shuttle shown in FIG. 6.

The shuttle body 70 further includes a center of gravity, which is shown in FIGS. 6 and 6*a* as CGsb. It will be noted that the geometric center C of the aperture 76 substantially coincides with the center of gravity CGsb of the shuttle body 70 in the example shown in the figures.

Figure 5A:
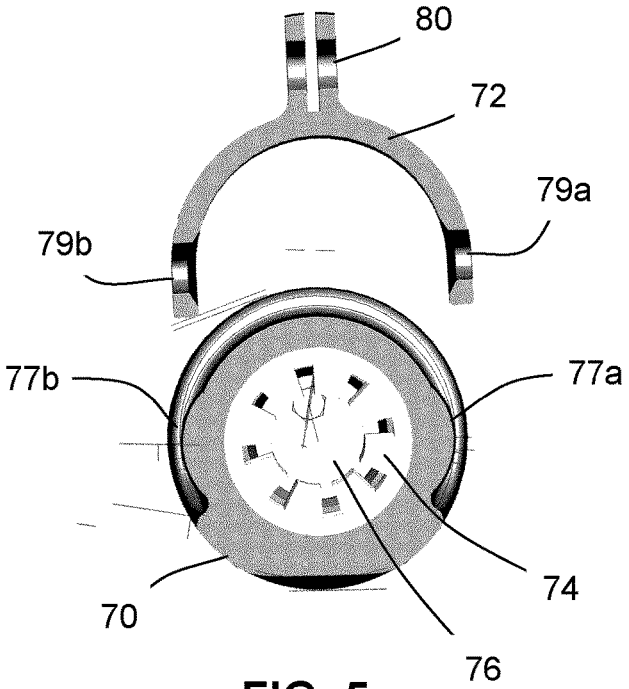
FIG. 5*a* is a sectional end view of the shuttle shown in FIG. 4.

Referring to FIGS. 5 and 5*a*, the shuttle body 70 includes two bosses 77*a* and 77*b* that are positioned to engage mounting apertures 79*a* and 79*b* on the pivot member 72, so as to support the pivot member 72 for pivotal movement about a pivot member axis Apm, wherein the pivot member axis Apm passes through the center C of the pass-through aperture 76 (also shown in FIG. 6*a*). Furthermore, the connection between the first end 46*a* of the cable 46 and a cable-receiving feature 80 on the pivot member 72 is rotationally free (e.g. akin to a pin joint).

When the wearer 11 is standing upright and looking directly forward as shown in FIG. 2, the cable will be oriented directly normal to the track 32 as shown in FIGS. 2 and 3. When the wearer 11 turns their head to the left or right, the tensioning device 48 will become laterally offset from the shuttle 34 which will cause the cable 46 to become angled off of the normal to the track 32. FIG. 6 shows a situation where the wearer 11 has turned their head by some amount, which causes the cable 46 to take on an angled orientation relative to the normal to the track 32. Because of the angle of the cable 46, there is a small component of the force Fc that urges the shuttle 34 to move along the track 32.

During operation, because the force Fc exerted by the cable 46 on the shuttle 34 passes proximate to the geometric center C of the aperture 76 of the shuttle body 70 (and may also be proximate the centre of gravity CGsb of the shuttle body 70), the force Fc applies substantially no torque on the shuttle body 70 that would tend to cause the bushing 74 to bite into the surface of the track 32. By contrast, if there was no pivot member provided on the shuttle body 70, and the cable 46 instead connected directly to the outer surface of the shuttle body 70, when the wearer 11 turned their head, the force in the cable 46 would cause a certain torque to be applied to the shuttle 34, thereby raising the risk of causing the leading edge of the bushing 74 to bite onto the surface of the track 32 and jam the shuttle 34. Nonetheless, it is contemplated that some embodiments of the stress mitigation system 30 could be constructed in that manner, particularly if the amount of friction between the bushing 74 and the track 32 is sufficiently low, or if the bushing 74 were replaced by some means that was more resistant to jamming (an example of which is described below).

It will be noted that the bosses 77*a* and 77*b* on the shuttle body 70 cooperate with the apertures 79*a* and 79*b* on the pivot member 72 to provide two useful features for the shuttle 34 and for the flexible elongate connector arrangement 36 in general. One useful feature is that, with a sufficient amount of force, the pivot member 72 can be removed from the shuttle body 70 non-destructively. The amount of force required for such an act can be selected based on the stiffness provided to the pivot member and the amount of engagement that exists between the bosses 77*a* and 77*b* and the apertures 79*a* and 79*b*. By making the pivot member 72 removable in this way, a quick release mechanism is provided to separate the headgear 10 from the bodywear member 38 (FIG. 2) so that, if the cable 46 becomes snagged, or if the wearer needs for whatever reason to remove the bodywear member 38 or the headgear 10, they can do so easily.

Figure 8A:
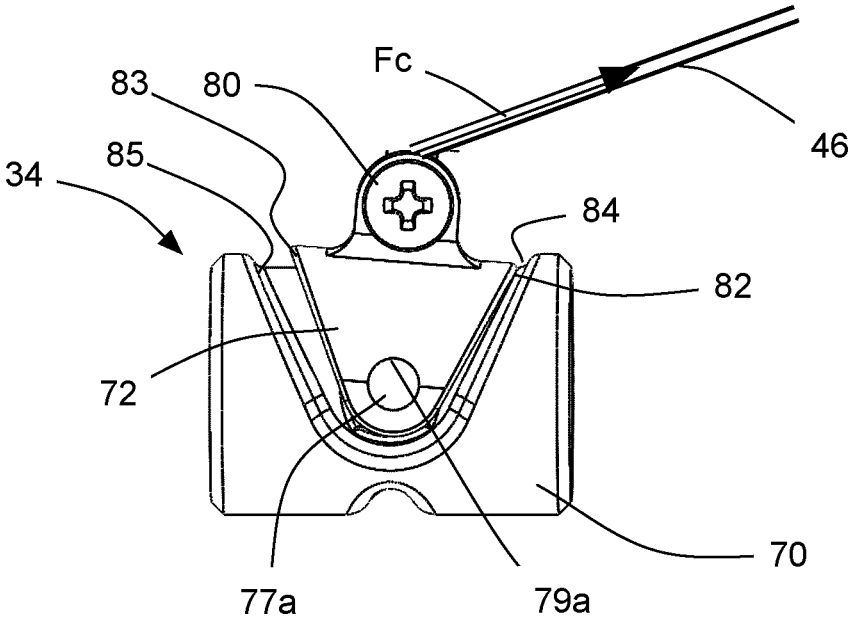
FIGS. 8*a* and 8*b* illustrate release of part of the shuttle in the event that a cable extending from the shuttle snags during operation.
Figure 8B:
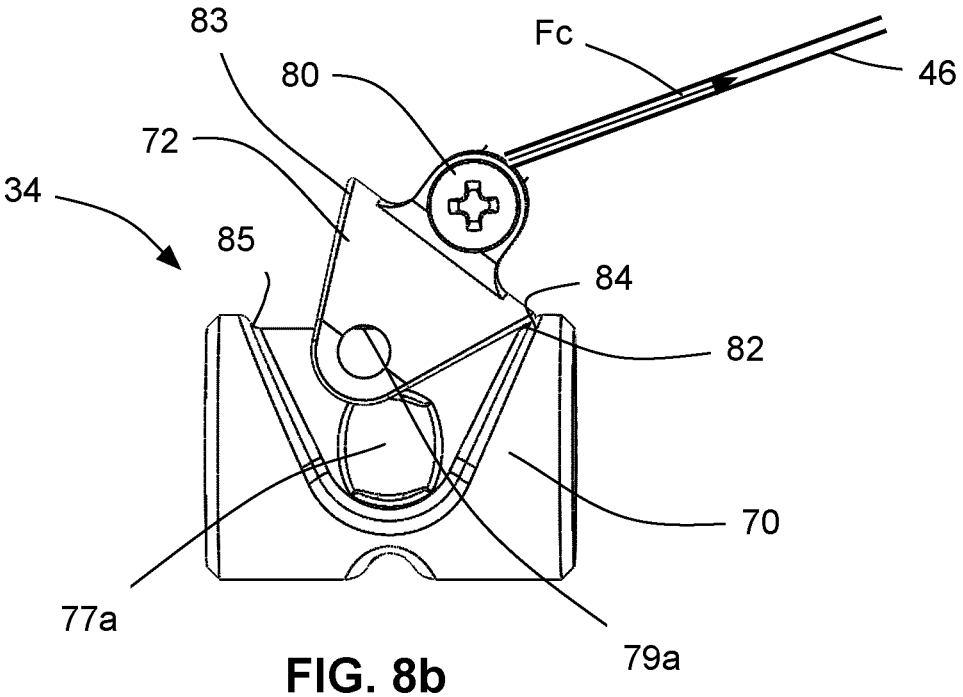
Figure 9:
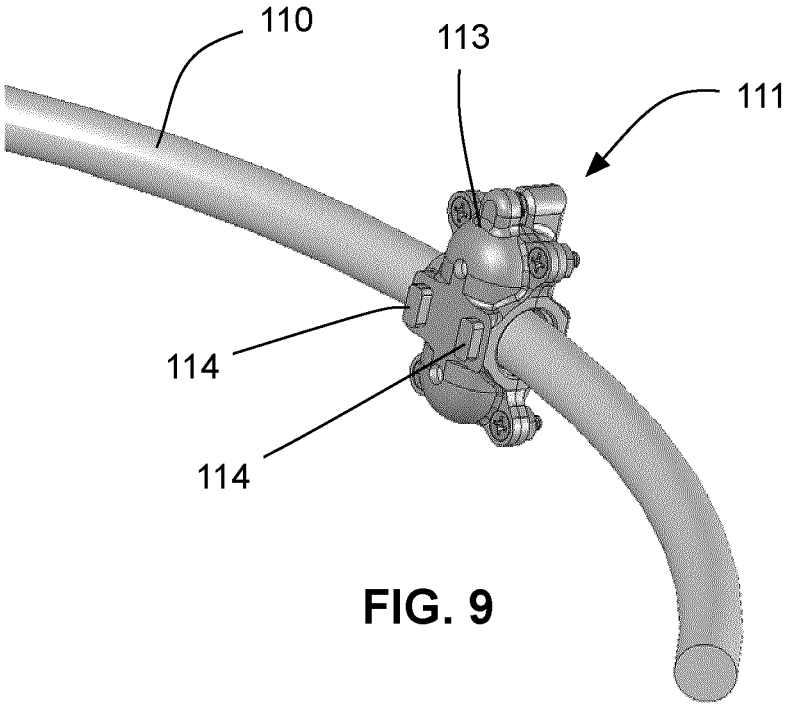
FIG. 9 is a perspective view of another variant of the shuttle for use on an arcuate track.

A second useful feature of the bosses 77*a* and 77*b* and the apertures 79*a* and 79*b* is illustrated in FIGS. 8*a* and 8*b*. FIG. 7*a* shows a situation where the cable 46 has become snagged on something during use of the headgear 10. As a result, the angle of the cable 46 causes the cable to pull the pivot member 72 all the way to one end of its travel. When the pivot member 72 reaches an end of its travel (as depicted in FIG. 8*a*) a first limit surface 82 on the pivot member 72 engages a first limit surface 84 on the shuttle body 70. Because of the position of the cable-receiving feature 80, the tension Fc in the cable 46 applies a torque on the pivot member 72 using the point of engagement between the limit surfaces 82 and 84 as a fulcrum. If the tension Fc in the cable 46 exceeds a selected tension, the torque applied by the cable 46 on the pivot member 72 will overcome the engagement between the bosses 77*a* and 77*b* and the apertures 79*a* and 79*b* and the pivot member 72 will be wrenched free from the shuttle body 70. This prevents damage to the shuttle 34 and to the other components of the stress mitigation system 30 in the event of snagging of the cable 46. Thus, the bosses 77*a* and 77*b* and the apertures 79*a* and 79*b* (which may, more broadly be referred to as boss-receiving features 79*a* and 79*b*), and optionally the limit surfaces 82 and 84, may together broadly be referred to as a snag-release system. The first limit surfaces 82 and 84 on the pivot member 72 and the shuttle body 70 respectively are shown on a first side of the pivot member 72 and the shuttle body 70 respectively. The first limit surfaces 82 and 84 cooperate to act as a fulcrum to permit automatic release of a snagged cable 46 for a selected cable tension through a first range of angles of the cable (e.g. a range of angles that is between 0 and about 90 degrees towards the right side of a longitudinal axis in the view shown in FIGS. 8*a* and 8*b*). The specific cable tension required to cause release of the pivot member 72 from the shuttle body 70 may depend on the specific angle of the cable 46 relative to the pivot member 72. There is also provided a second limit surface 83 and a second limit surface 85 on an opposing second side of the pivot member 72 and the shuttle body 70 respectively. The second limit surfaces 83 and 85 operate in the same manner as the first limit surfaces 82 and 84, but for a second range of angles of the cable 46 (e.g. a range of angle that is between 0 and about 90 degrees towards the left side of a longitudinal axis). The first limit surfaces 82 and 84 are described as acting as a fulcrum for a range of angles on the right side of a longitudinal axis (i.e. the axis passing between the head and feet of the wearer 11), and the second limit surfaces 83 and 85 are described as acting as a fulcrum for a range of angles on the left side of the longitudinal axis. However, it is possible to provide an embodiment wherein for the first limit surfaces 82 and 84 to be repositioned to act as a fulcrum for the left side of the longitudinal axis and for the limit surfaces 83 and 85 to act as a fulcrum for the right side of the longitudinal axis.

Figure 11:
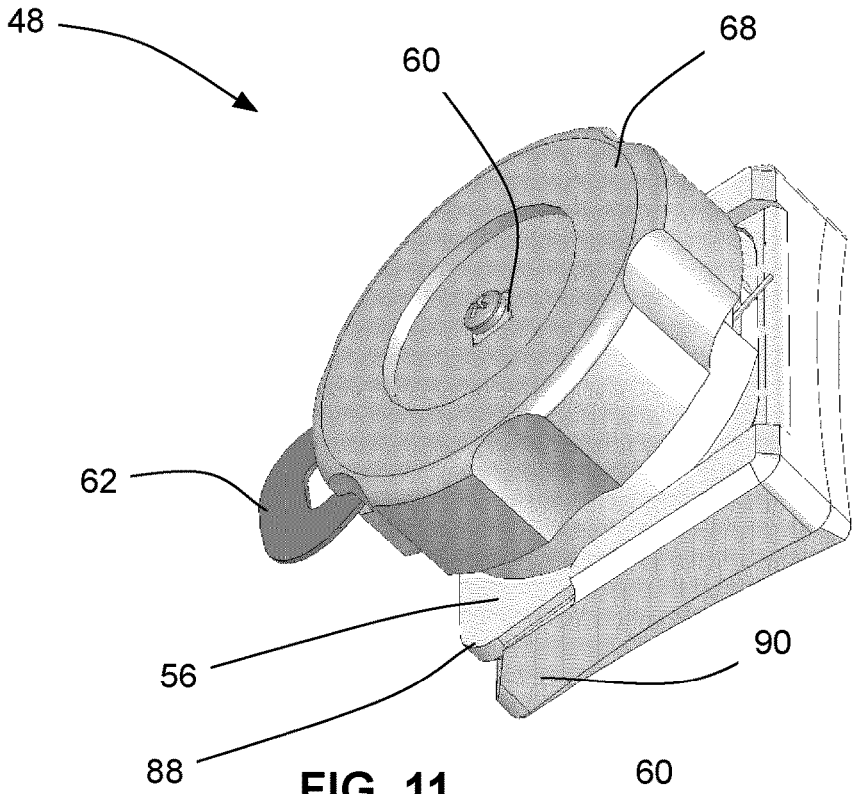
FIG. 11 is a perspective view of a tension adjustment device that adjusts tension in a cable and which is part of the stress mitigation system shown in FIG. 3.
Figure 12:
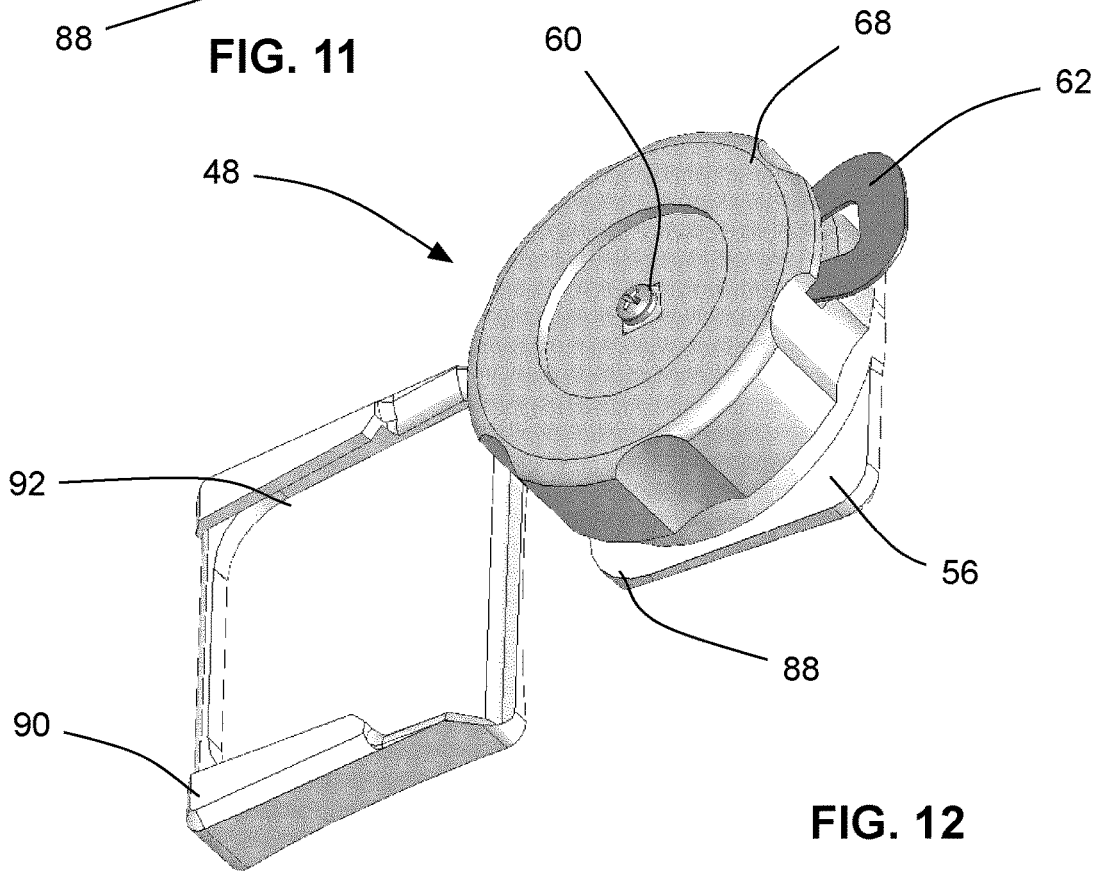
FIG. 12 is an exploded perspective view of the tension adjustment device and a holder for the tension adjustment device shown in FIG. 11.

With reference to FIGS. 11 and 12, another optional way of providing a quick release mechanism to permit separating the headgear 10 from the bodywear member 38, may be by providing a flange 88 on the tensioner device housing 56 and by providing a base 90 configured to releasably hold the flange 88. For example, the base 90 may mount fixedly to the back of the helmet 12 and may have an upwardly facing slot 92, which is sized to hold the flange 88 on the device housing 56. During operation the tension Fc in the cable 46 will apply a downward force on the tensioning device 48, which will keep it held in the slot 92. When the wearer 11 wishes to remove the tensioning device 48 he or she may lift the device 48 from the slot 92 in the base 90.

In an alternative embodiment, the track may extend along a circular arc instead of extending along a straight path as it does in the embodiment in FIG. 3. The circularly arced track may still be considered to extend laterally, however, even if not directly laterally. In such an embodiment, the other elements that make up the stress mitigation system 30 may be the same as those shown in FIGS. 2-8*b* and 11-15, but with the following difference. The shuttle may include a bushing that is formed to have an arcuately-extending aperture therethrough that matches the curvature of the arcuate arc that the track follows.

Figure 10A:
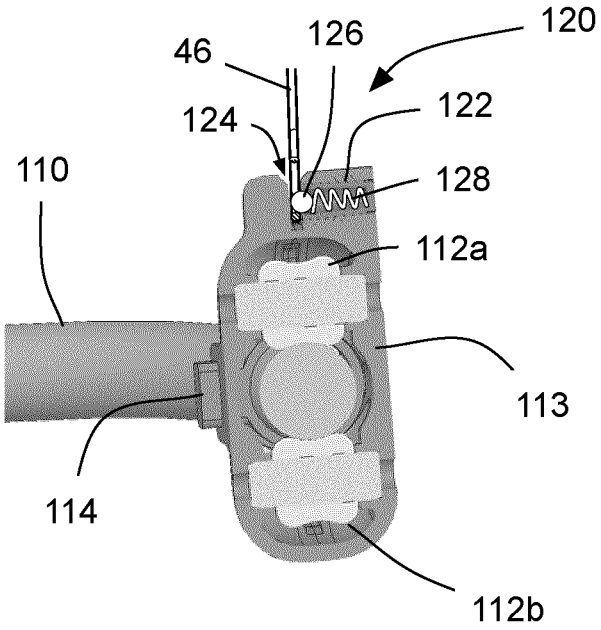
FIG. 10*a* is a sectional elevation view of the shuttle shown in FIG. 9.

In another embodiment shown in FIGS. 9 and 10*a*-10*d*, the track 110 may follow a circular arc, or it may be arcuate and follow a non-circular arc. In this embodiment, the shuttle, shown at 111 includes a plurality of rollers 112 including a single first roller 112*a* and a single second roller 112*b* that is positioned directly opposite to the first roller 112*a* on the track 110. The rollers 112 are held in a shuttle housing 113 and are configured to roll along the track 110. As shown in FIG. 10*a*, the rollers 112 have a shallow groove on their contact edge so as to cup the track 110 by some selected amount, so as to center the shuttle 111 on the track 110. Because there is only a single pair of diametrically opposed rollers 112*a* and 112*b*, the track is not limited to follow a circular arc. In this embodiment, even though there is no pivot member, the use of rollers instead of a bushing eliminates the problem of digging in caused by a cable tension that does not pass through the center of the aperture through which the shuttle 111 receives the track 110.

Figure 10B:
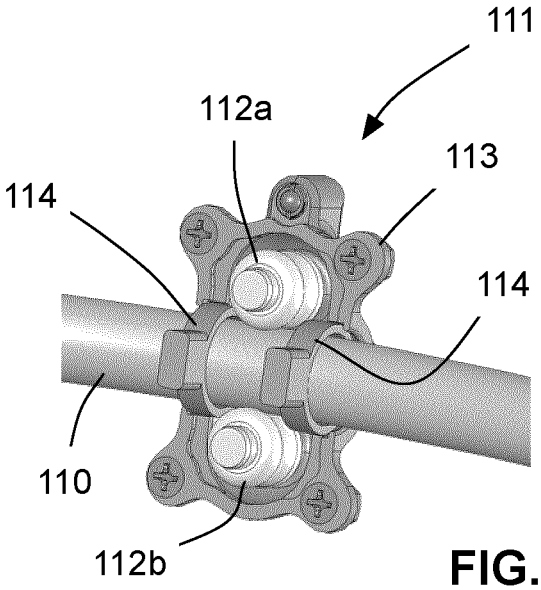
FIG. 10*b* is a perspective view of the shuttle shown in FIG. 9, with a portion of the housing of the shuttle removed to show the elements within.
Figure 10C:
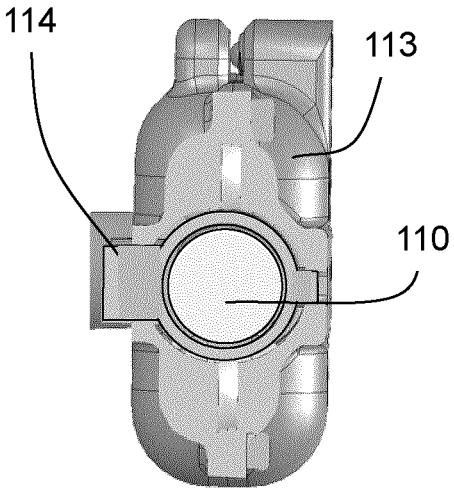
FIGS. 10*c* and 10*d* are additional sectional elevation views of the shuttle shown in FIG. 9.
Figure 10D:
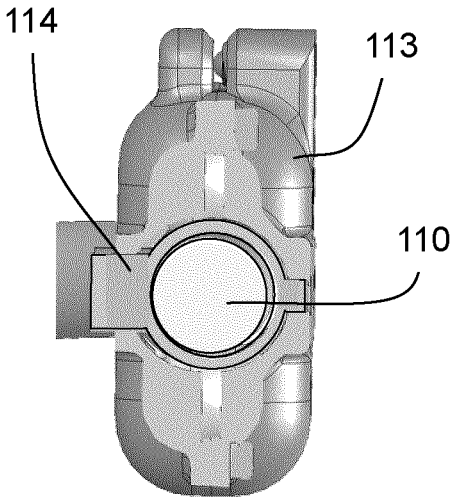

As shown in FIG. 10*b*, the shuttle 111 may include optional brake members 114 that can be positioned in an unbraked position (FIG. 10*c*) in which they are spaced from the track 110 and a braked position (FIG. 10*d*) in which they are frictionally engaged with the track 110. In the braked position, the shuttle 111 is inhibited by the brake members 114 from moving along the track 110, particularly in the embodiment shown in FIG. 9 wherein the track 110 is arcuate. The brake members 114 may be held in their respective positions frictionally in the shuttle housing 113.

The braked position may be useful when the wearer 11 wishes to keep their head in substantially one position for a long period of time without the need to turn their head.

The shuttle 111 includes a snag-release system 120 that differs from the snag-release system provided on the shuttle 34. The snag-release mechanism 120 includes a ball plunger 122 mounted to the shuttle body 113. The first end 46*a* of the cable 46 is a loop that is captured in a slot 124 by the ball 126 from the ball plunger 122. In the event that the cable 46 snags on something during operation, the first end 46*a* pushes back the ball 126 against the urging of the spring 128 from the ball plunger 122 and releases from the slot 124.

Figure 16:
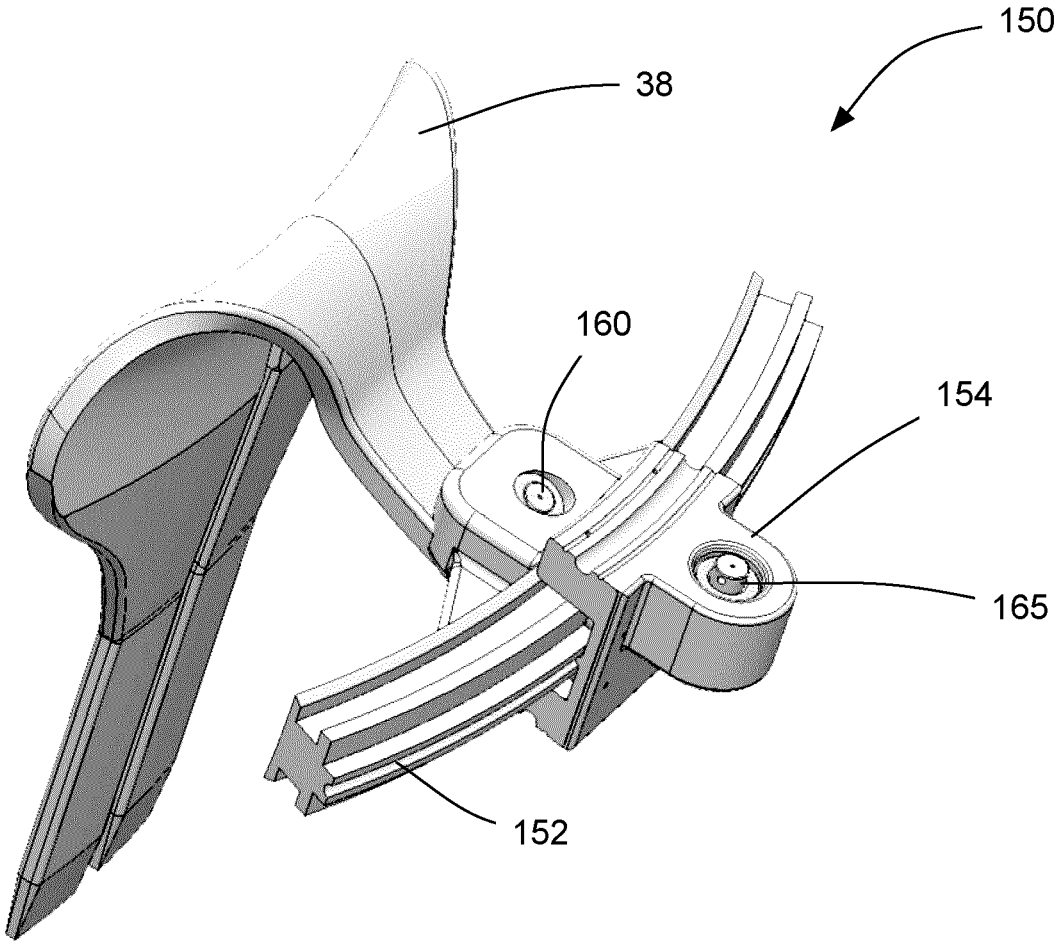
FIG. 16 is a perspective view of another embodiment of a stress mitigation system for mitigating stresses in a wearer of a headgear, which includes a shuttle that incorporates rollers instead of a slide bushing.
Figure 18:
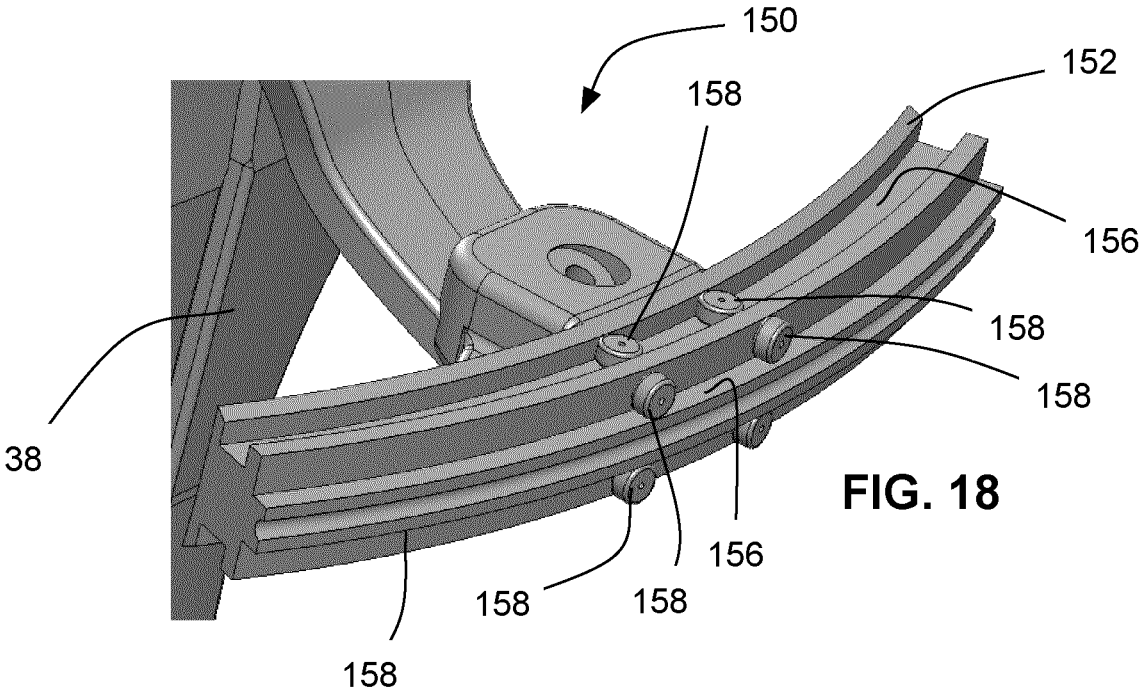
FIG. 18 is a perspective view illustrating removal of the track and shuttle from the wearer.

FIG. 16 shows an alternative embodiment of a stress mitigation system 150, which includes a track 152 and a shuttle 154. The track 152 differs from the track 110 in that the track 152 does not have a circular cross-sectional shape. Instead it has a shape that includes specific shoulders 156 that are for the purpose of supporting wheels 158 on the shuttle 154. The wheels 158 are shown without the rest of the shuttle 154 in FIG. 18.

Figure 17:
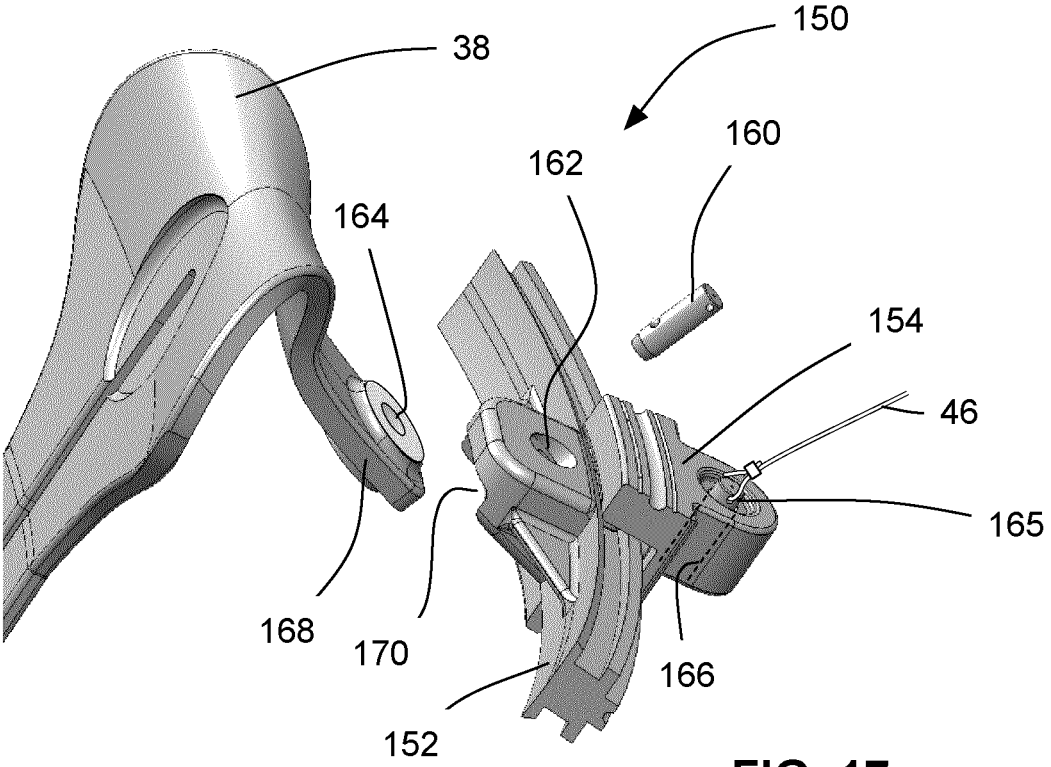
FIG. 17 is a perspective view showing the track and rollers from the shuttle shown in FIG. 16.

FIG. 17 depicts a feature of the system 150 that is advantageous. Specifically, the system 150 includes a quick release to permit release the track 152 from the bodywear member 38, and another quick release to permit release of the cable 46 from the shuttle 154. This permits the wearer 11 to change out the track and shuttle for another one, either as a replacement one if there is damage to the one they are wearing, or to utilize a different one that is more applicable for a specific activity they are carrying out.

The quick release is provided in part by a first lateral thrust ball plunger 160 that passes through aligned first and second apertures 162 and 164 in the track 152 and the bodywear member 38, and in part by a second lateral thrust ball plunger 165 that passes through an aperture 166 in the shuttle 154. The bodywear member 38 may include a flange 168 that is retained in a slot 170 in the track 152. The first ball plunger 160 releasably locks the bodywear member 38 and the track 152 together by preventing the withdrawal of the flange 168 from the slot 170. The second ball plunger 165 releasably holds the cable 46 to the shuttle 154. Either ball plunger 165 or 160 may be used to provide a quick release to permit the wearer 11 to disconnect the headgear 10 from the bodywear member 38.

Figure 19:
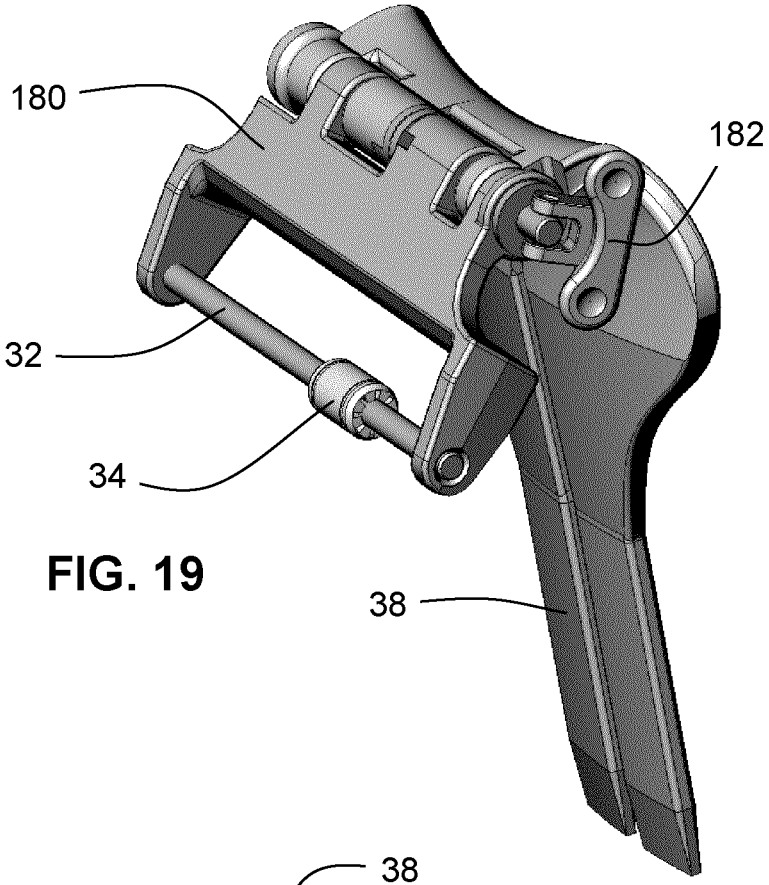
FIG. 19 is a perspective view of a variant of the track member shown in FIG. 3, that shows adjustability.

FIG. 19 shows a variant of the bodywear member 38, which incorporates an adjustment mechanism to permit adjustment of the distance of the shuttle 34 and track 32 are from the center of gravity of the headgear 10, which permits the shuttle 34 and track 32 to be moved out of the way if there is an obstacle that would otherwise interfere with the user's activity. The adjustment mechanism includes a pivot connection between a track support 180 that supports the track 32 and the bodywear member 38, and an over-center cam lock member 182 that may be similar the quick-release structures on a typical bicycle that holds the front wheel releasably to a fork on a bicycle frame. When the cam lock member 182 is levered to a locked position, the elements that engage one another as part of the pivot connection are clamped so as to frictionally lock the position of the track support 180.

Figure 20:
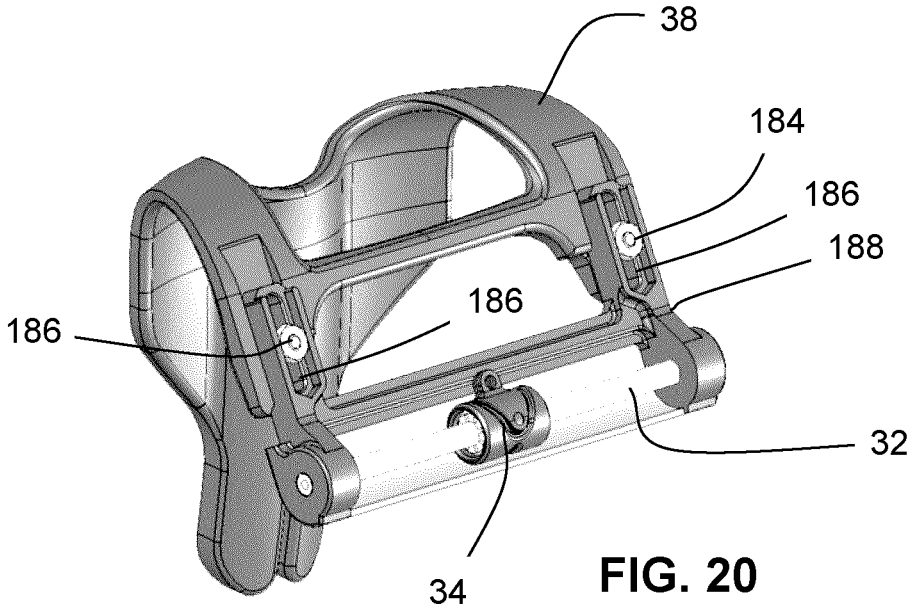
FIG. 20 is a perspective view of another variant of the track member shown in FIG. 3, that shows adjustability.

The adjustment mechanism shown in FIG. 19 permits adjustment of the position of the track 32 and shuttle 34 via a pivoting movement of a track support. FIG. 20 shows another variant of the bodywear member 38, which incorporates another adjustment mechanism, which permits adjustment of the position of the track 32 and shuttle 34 via linear movement. Each of a pair of fasteners 184 may extend through a slotted aperture 186 in the track support member shown at 188, and may further pass through another aperture (not shown) in the bodywear member 38. The other aperture that is not shown may be a threaded circular aperture and need not be slotted. When the fasteners 184 are tightened the track 32 is locked in position. When the fasteners are loosened the track support member 188 can be slid linearly to a new desired position at which point the fasteners 184 can be tightened to lock the position of the track 32.

Figure 21:
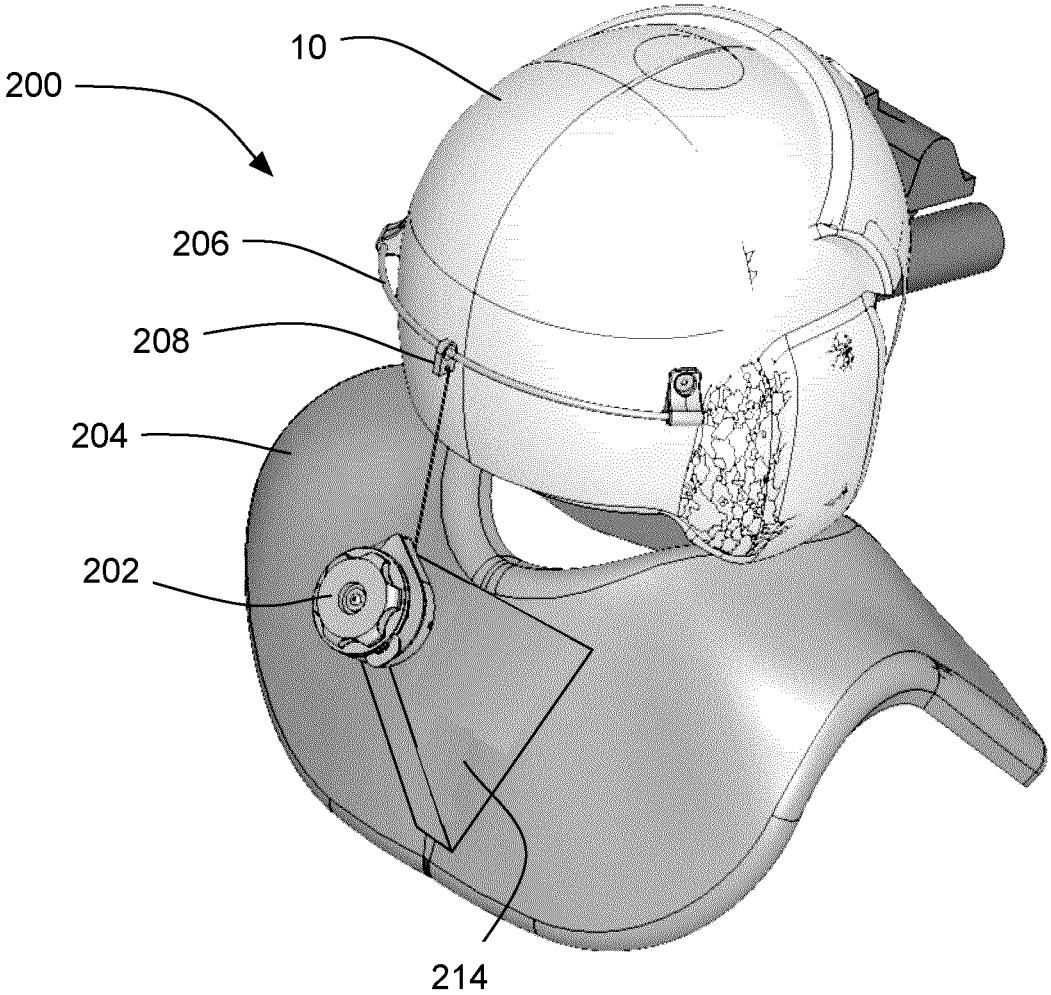
FIG. 21 is a perspective view of another embodiment of a stress mitigation system for mitigating stresses in a wearer of a headgear, in which a track and shuttle are mounted to the headgear.
Figure 22:
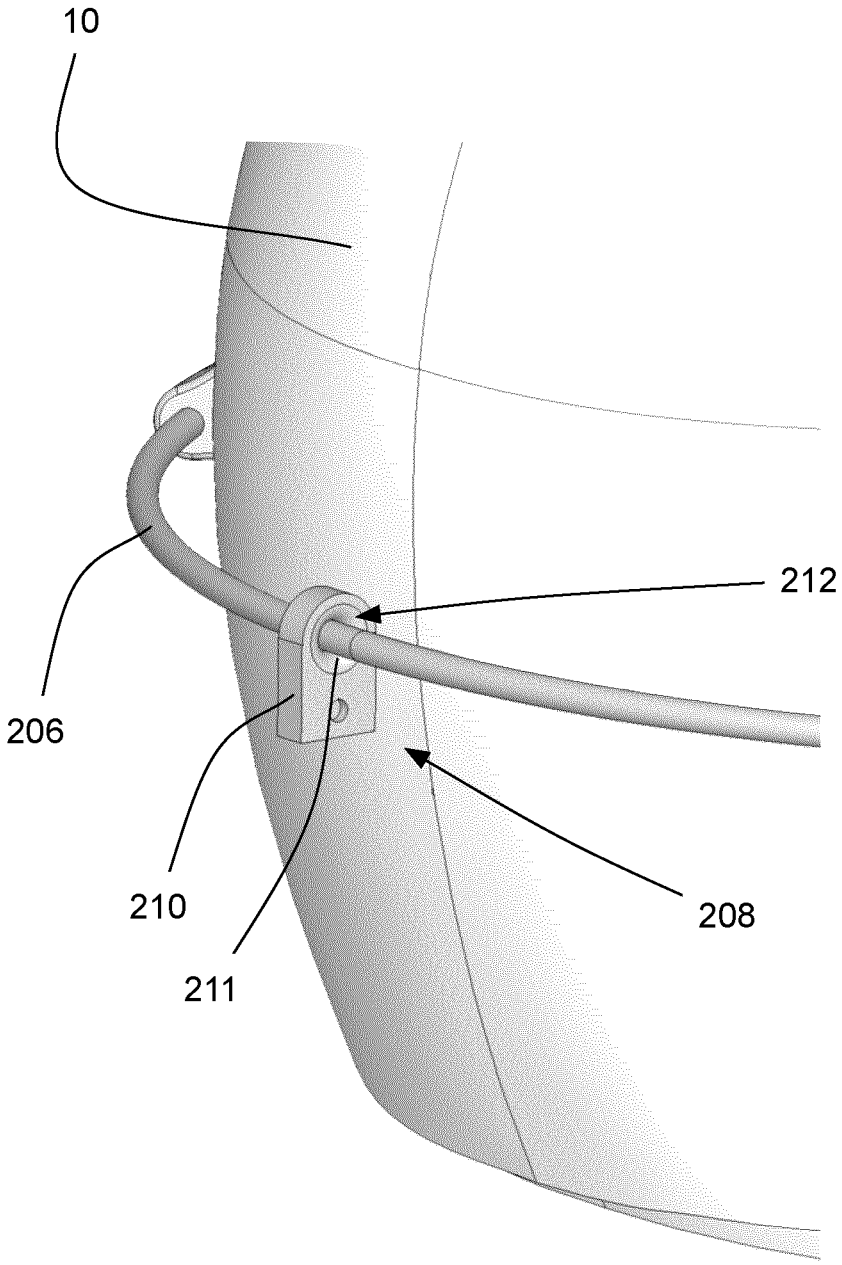
FIG. 22 is a magnified perspective view of the track and shuttle shown in FIG. 21.

Reference is made to FIG. 21, which shows another embodiment of a stress mitigation system 200. The stress mitigation system 200 may be similar to the stress mitigation system 30, but provides a tensioning device 202 that is mounted to a bodywear member 204, and a track 206 that is mounted to the headgear 10. The shuttle is shown at 208. A cable 209 extends between the shuttle 208 and the tensioning device 202. The track 206 may be similar to the track 32 and may have a circular cross-sectional shape, but extends along an arcuate path. For example, the track 206 may extend along a circular arc. The shuttle 208 may be any suitable type of shuttle shown in the figures. In the example shown, the shuttle 208 comprises a plate 210 (FIG. 22) with a bushing 211 that has a rounded profile and defines a pass-through aperture 212 for the track 206. The cable 209 (FIG. 21) may be similar to the cable 46. The tensioning device 202 may be similar to the tensioning device 48 but is fixedly connected to a bodywear member, such as bodywear member 204. The tensioning device 202 is shown in FIG. 21 connected to the bodywear member 204 by large solid connector member 214; however, they may be connected by any suitable type of connection.

Figure 23:
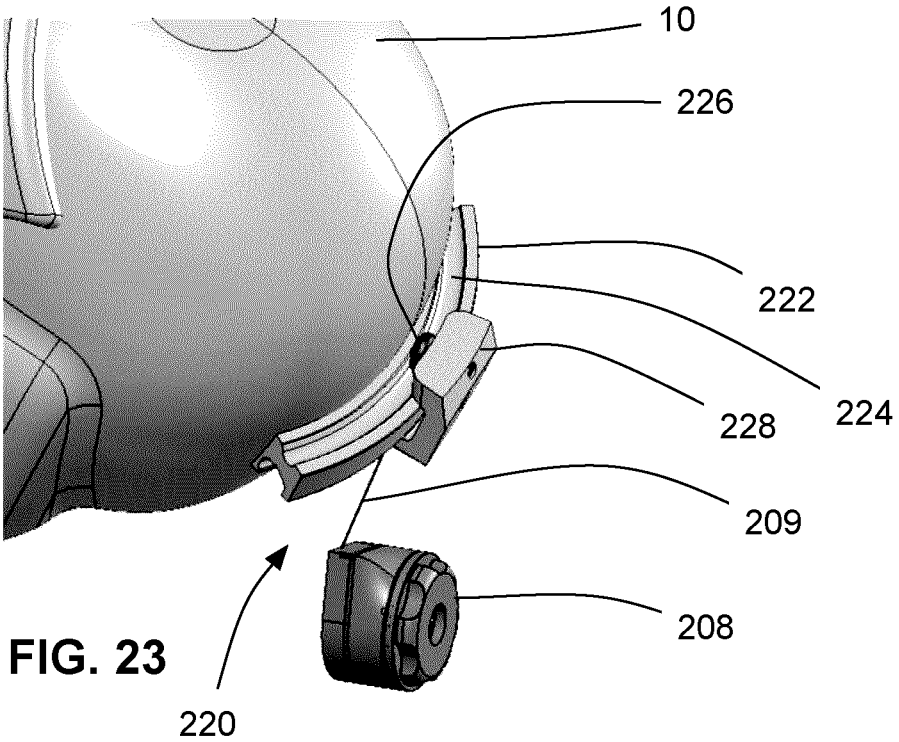
FIG. 23 is a perspective view of a variant of the system for mitigating stresses shown in FIG. 21, in which the shuttle incorporates rollers instead of a slide bushing.
Figure 24:
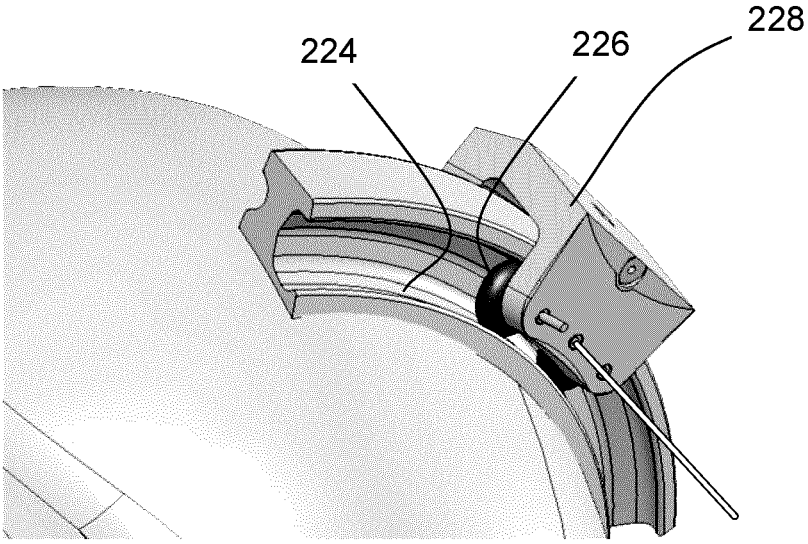
FIG. 24 is another perspective view of the variant shown in FIG. 23.

FIGS. 23 and 24 show an embodiment of a stress mitigation system 220 in which the track (shown at 222) includes specific shoulders 224 for supporting rollers 226 on a shuttle 228. The track 222 is mounted in this embodiment to the headgear 10. The tensioning device 202 and the cable 209 may be the same as they are in the embodiment in FIG. 21.

Figure 25:
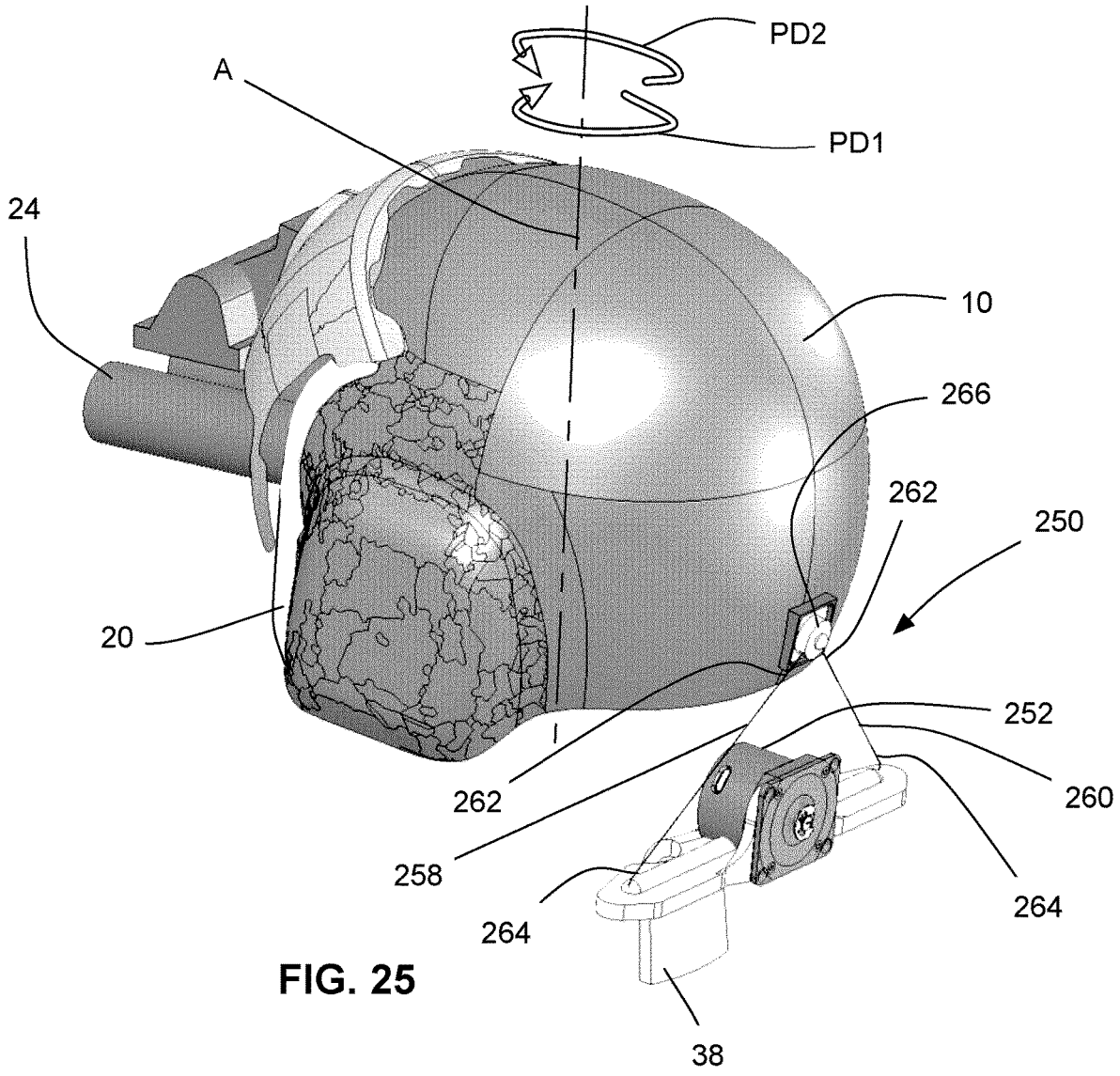
FIG. 25 is a perspective view of another embodiment of a stress mitigation system for mitigating stresses in a wearer of a headgear, in which there are first and second cable segments extending between the headgear and a cable take-up device.

Reference is made to FIG. 25, which shows another embodiment of a stress mitigation system 250. The stress mitigation system 250 includes a tensioning device 252, a first spool 254 (FIG. 26), a second spool 256 (FIG. 27), a first cable 258 and a second cable 260. The first cable 258 has a first force transfer cable segment 258*a* and a first spool engagement cable segment 258*b*. Similarly, the second cable 260 has a second force transfer cable segment 260*a* and a second spool engagement cable segment 260*b*. Each force transfer cable segment 258*a* and 260*a* has a first end 262 and a second end 264. The first ends 262 of the force transfer cable segments 258*a* and 260*a* are mounted to one of the headgear 10 and the bodywear member 38. In the example shown in FIG. 25, the first ends 262 are mounted to the headgear 10, via a first end mount 266, which will be described in further detail below. The second ends 264 are mounted to the other of the headgear 10 and the bodywear member 38. In the example shown in FIG. 25, the second ends 264 are mounted to the bodywear member 38.

The first ends 262 are laterally inboard from the second ends 264 and are vertically spaced from the second ends 264 such that, during pivoting movement of the head 20 of the wearer 11 in a first pivot direction PD1 about the vertical axis A, the first force transfer cable segment 258*a* changes orientation towards a vertical orientation (FIG. 29) and the second force transfer cable segment 260*a* changes orientation towards a horizontal orientation, and during pivoting movement of the head 20 of the wearer 11 in a second pivot direction PD2 about the vertical axis A, the first force transfer cable segment 258*a* changes orientation towards the horizontal orientation (FIG. 30) and the second force transfer cable segment 260*a* changes orientation towards the vertical orientation.

Figure 26:
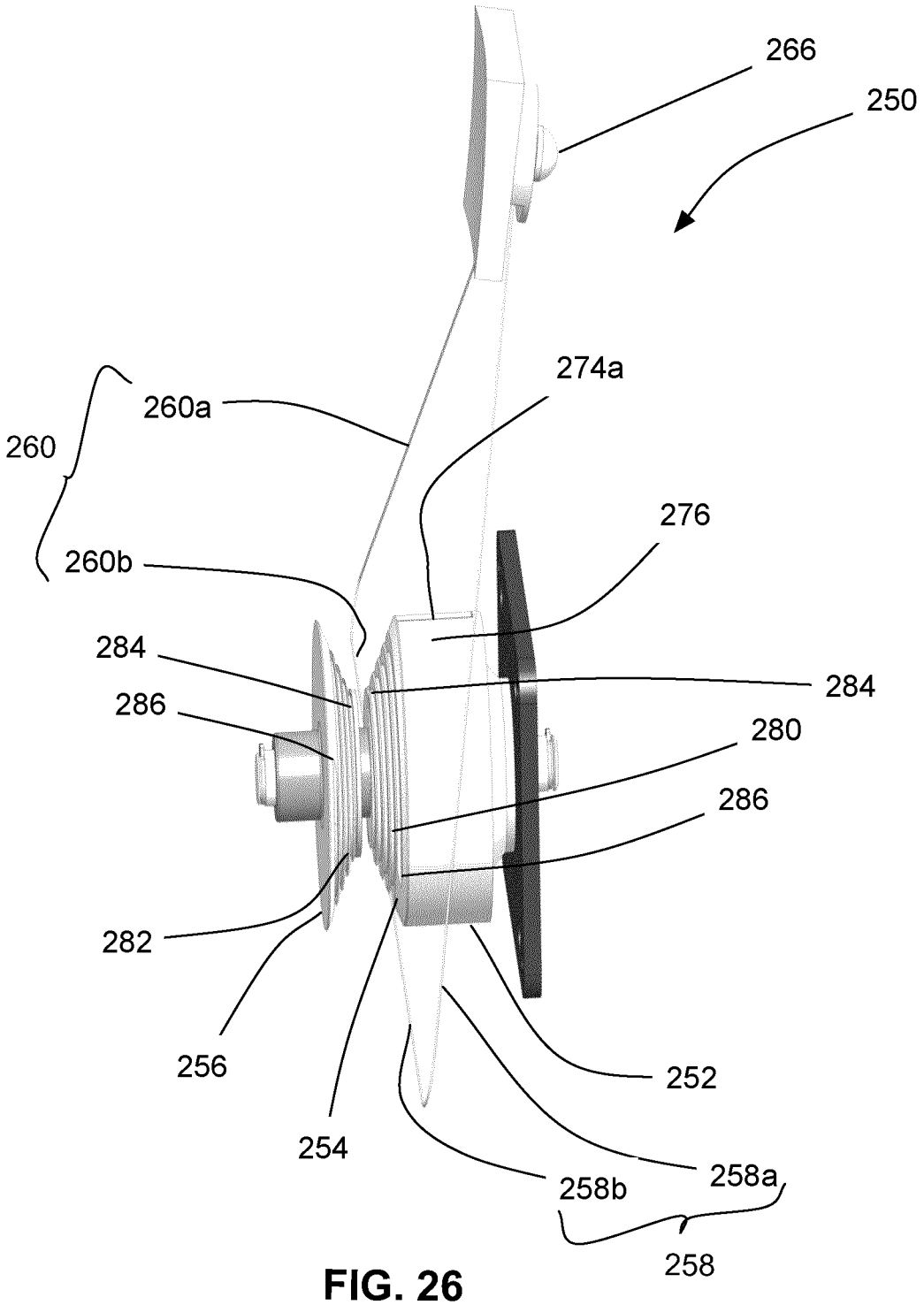
FIG. 26 is another perspective view of the embodiment shown in FIG. 25.
Figure 27A:
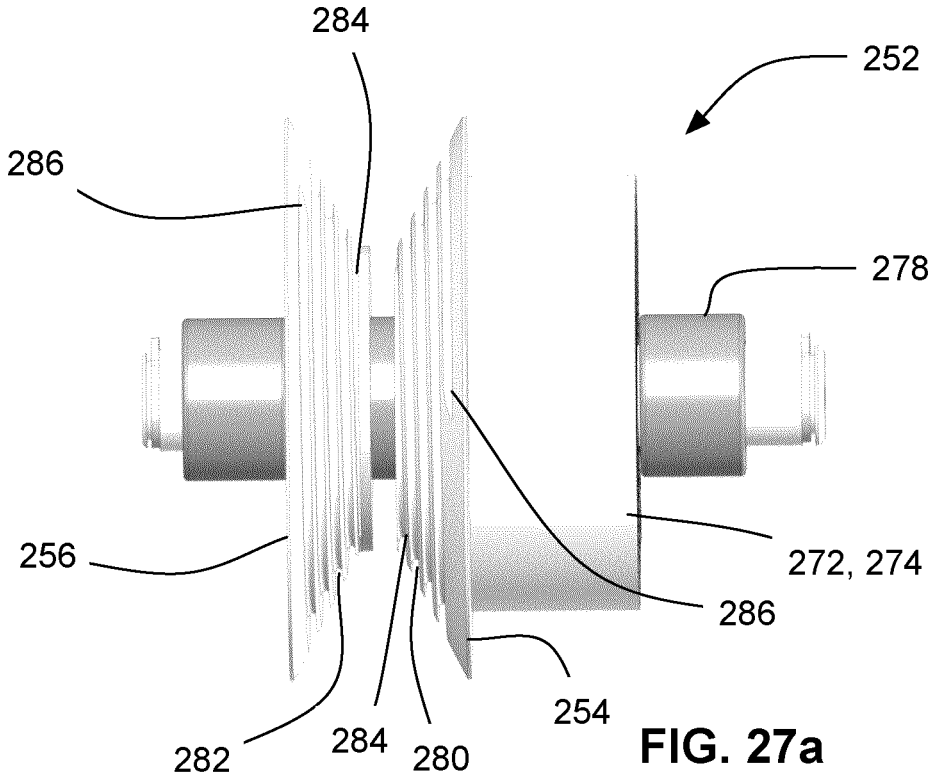
FIG. 27*a* is an elevation view of the cable take-up device shown in FIG. 25, with certain components removed.
Figure 28:
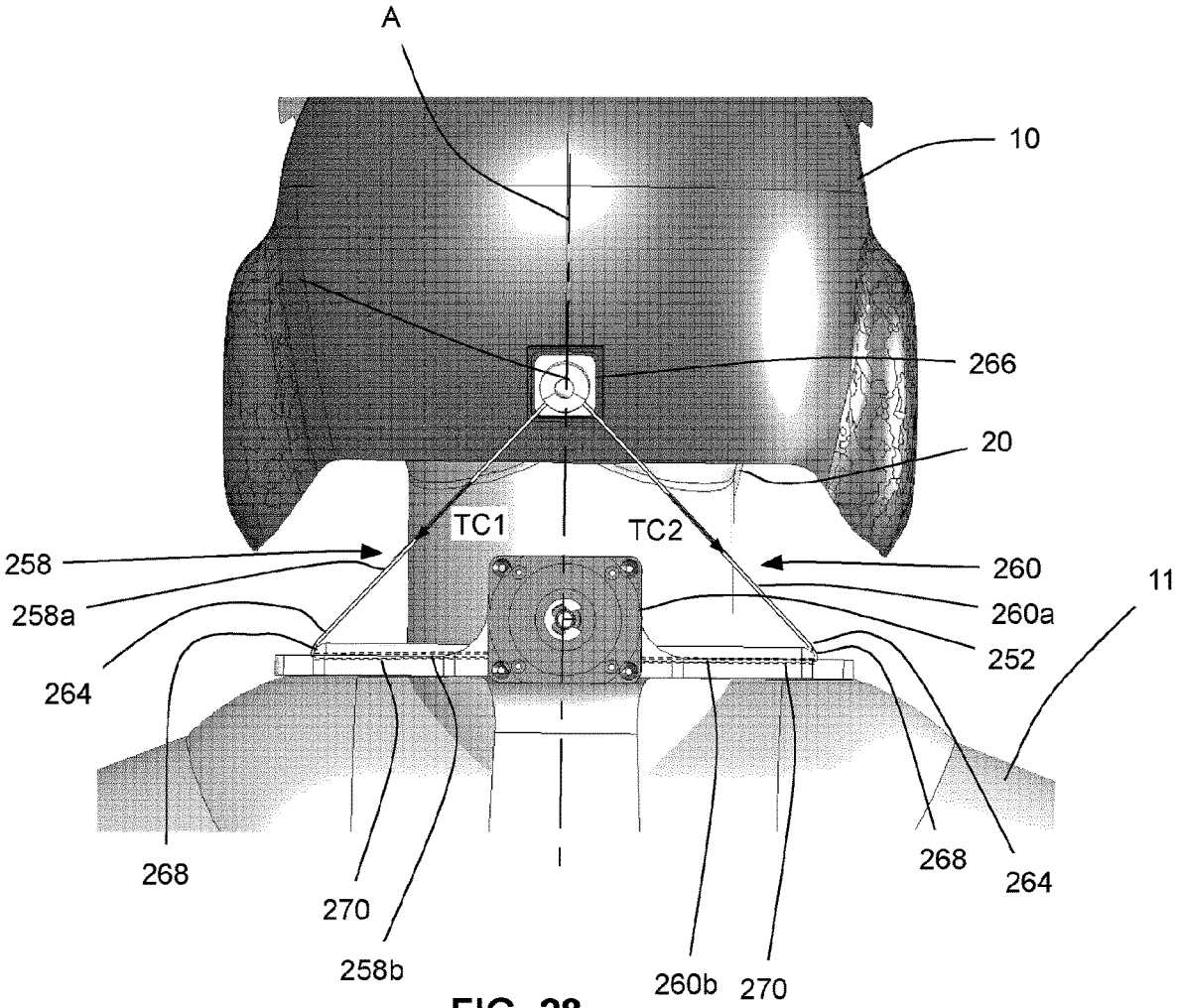
FIG. 28 is a rear elevation view of a wearer pointing his/her head directly forward to illustrate the forces exerted by the system on the head of the wearer

Referring to FIGS. 26 and 28, the second ends 264 of the first and second force transfer cable segments 258*a* and 260*a* engage a guide feature 268 (FIG. 28) at each lateral end of the bodywear member 38 and connect to the spool engaging cable segments 258*b* and 260*b*, which extend through pass-through apertures 270 (FIG. 28) in the bodywear member 38 and are received on the first and second spools 254 and 256 respectively (FIG. 26).

Figure 27B:
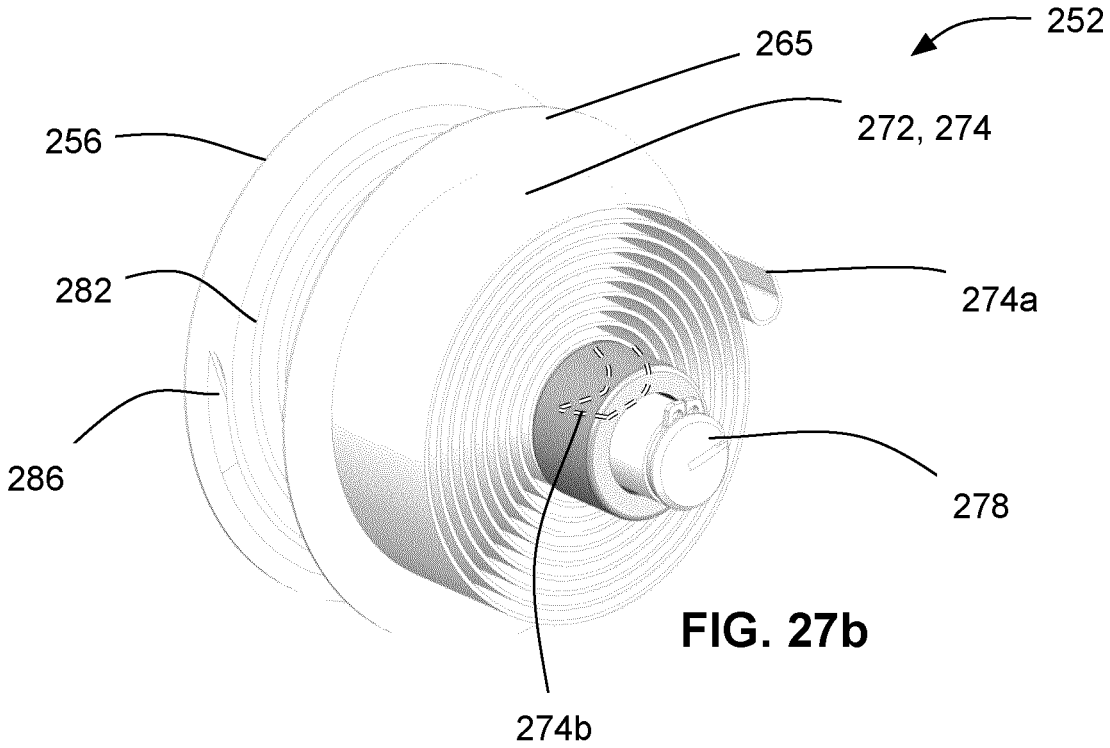
FIG. 27*b* is a perspective view of the cable take-up device shown in FIG. 27.

The tensioning device 252 maintains tension in the first and second cables 258 and 260 by means of a biasing member 272 that may be referred to as a cable segment biasing member 272. The biasing member 272 may be, for example, a clock spring 274 that has a first end 274*a* and a second end 274*b*. The first end 274*a* may be engaged with a wall 276 (by passing through a radial slot in the wall 276 as shown in FIG. 26) wherein the wall 276 is part of the first spool 254. The second end 274*b* may be engaged with a shaft 278 (e.g. may be received in a slot in the shaft 278 as shown in FIG. 27*b*) that is part of the second spool 256. The first spool 254 may be rotatably supported on the shaft 278 (e.g. via a bushing), so that the first and second spools 254 and 256 are rotatable relative to one another. By connecting the ends 274*a* and 274*b* of the clock spring 274 to the two spools 254 and 256, the spools 254 and 256 are biased in selected rotational directions that are opposite to one another and which maintain tension in the first and second cables 258 and 260.

Figure 29:
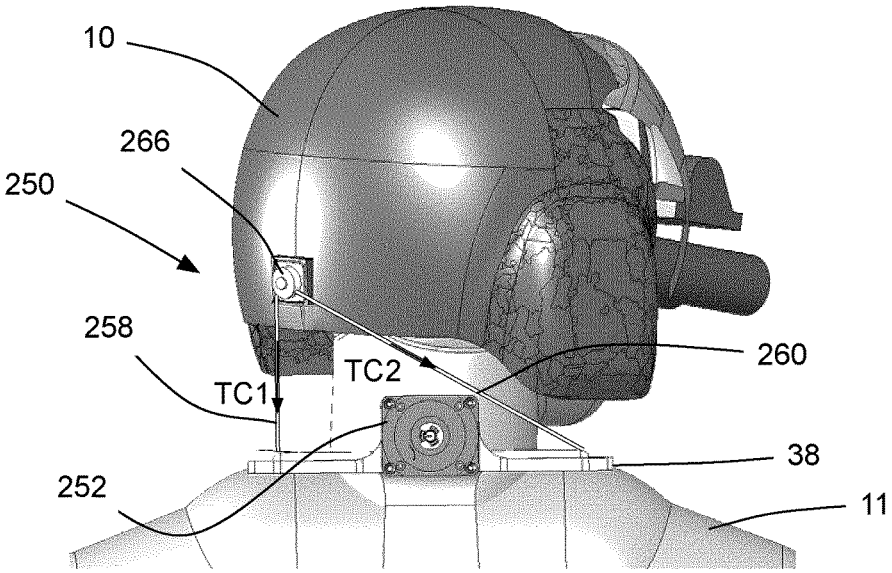
FIG. 29 is a rear elevation view of a wearer turning his/her head to one side to illustrate the forces exerted by the system on the head of the wearer.
Figure 30:
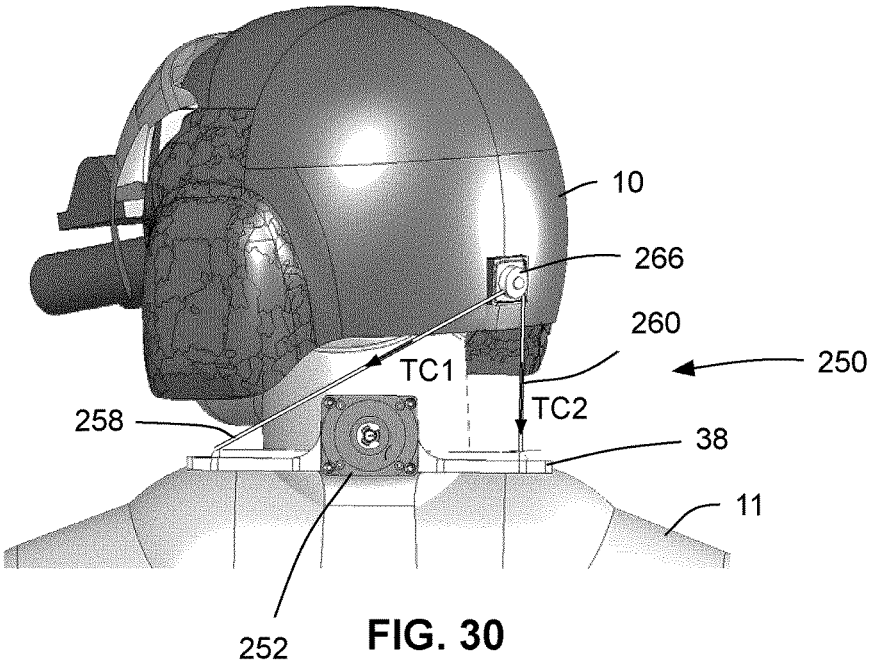
FIG. 30 is an elevation view of a wearer turning his/her head to the other side to illustrate the forces exerted by the system on the head of the wearer.

The tensions in the two cables 258 and 260 are shown at TC1 and TC2 respectively in FIGS. 28-30. FIG. 28 represents a situation where the head 20 of the wearer 11 is pointing directly forward. In such an instance, the cable segments 258 and 260 each have respective tensions TC1 and TC2. Because the angles of the force transfer cable segments 258*a* and 260*a* are substantially equal and opposite, it will be appreciated that the lateral components of the tensions TC1 and TC2 are substantially equal and opposite and therefore substantially cancel each other out so that there is substantially no net torque acting on the wearer's head 20 urging it about the vertical axis A. The vertical components of the tensions TC1 and TC2 add to one another and cooperate to apply a torque to the head 20 of the wearer 11 to counteract the torque applied by the weighted elements such as the night vision goggles 14 shown in FIG. 25.

When the wearer 11 turns his/her head 20 in the first pivot direction PD1 (FIG. 25), the angles of the force transfer cable segments 258*a* and 260*a* change such that the first cable segment 258*a* moves towards a vertical orientation and the second cable segment 260*a* moves towards a horizontal orientation. If the tensions TC1 and TC2 in the two cable segments 258*a* and 260*a* remained the same magnitude, then the tension TC2 in the cable segment 260*a* would apply a significant lateral torque on the head 20 of the wearer 11 that would be substantially unopposed by the tension TC1 in the first cable segment 258*a*. Similarly, when the wearer 11 turns his/her head 20 in the second pivot direction PD2 (FIG. 25), if the tensions TC1 and TC2 remained the same magnitude, then the tension TC1 in the cable segment 258*a* would apply a significant lateral torque that would be substantially unopposed by the tension TC2. These resultant lateral torques would be experienced by the wearer 11 as a resistance to turning of his/her head 20, which would be undesirable, and so to address this, the tensioning device 252 is configured to reduce tension in any of the first and second force transfer connector segments 258*a* and 260*a* that changes orientation towards the horizontal orientation and to increase tension in any of the first and second force transfer connector segments 258*a* and 260*a* that changes orientation towards the vertical orientation.

To accomplish this, the first and second spools 254 and 256 each have a groove (shown at 280 and 282 respectively in FIGS. 26 and 27*a*) for retaining the associated one of the first and second spool engaging connector segments 258*b* and 260*b*, wherein the groove 280 or 282 on each spool 254 or 256 has a progressively increasing diameter from a first groove end 284 to a second groove end 286, such that when the spool 254 or 256 pays out the associated spool engaging connector segment 258*b* or 260*b*, the associated spool engaging connector segment 258*b* or 260*b* leaves the groove 280 or 282 at a progressively increasing diameter and when the spool 254 or 256 reels in the associated spool engaging connector segment 258*b* or 260*b*, the associated spool engaging connector segment leaves the groove 280 or 282 at a progressively decreasing diameter. By changing the diameter at which the first and second spool engaging cable segments 258*b* and 260*b* leave the spools 254 and 256, the spring force from the biasing member 272 results in a changing tension TC1 and TC2 in the cable segments 258*b* and 260*b* and therefore in the cable segments 258*a* and 260*a*. In other words, the tension in either cable 258 or 260 depends on the diameter at which that cable 258 or 260 leaves the associated groove 280 or 282 on the associated spool 254 or 256. In this way, as the wearer 11 turns his/her head 20, the tension drops in the cable segment 258*a* or 260*a* that reorients towards a more horizontal orientation thereby reducing any lateral torque applied to the wearer's head 11, and the tension increases in the cable segment 258*a* or 260*a* that reorients towards a more vertical orientation to ensure that a sufficient torque is applied to the wearer's head 11 to counteract the torque applied by elements such as the night vision goggles 14.

Figure 31:
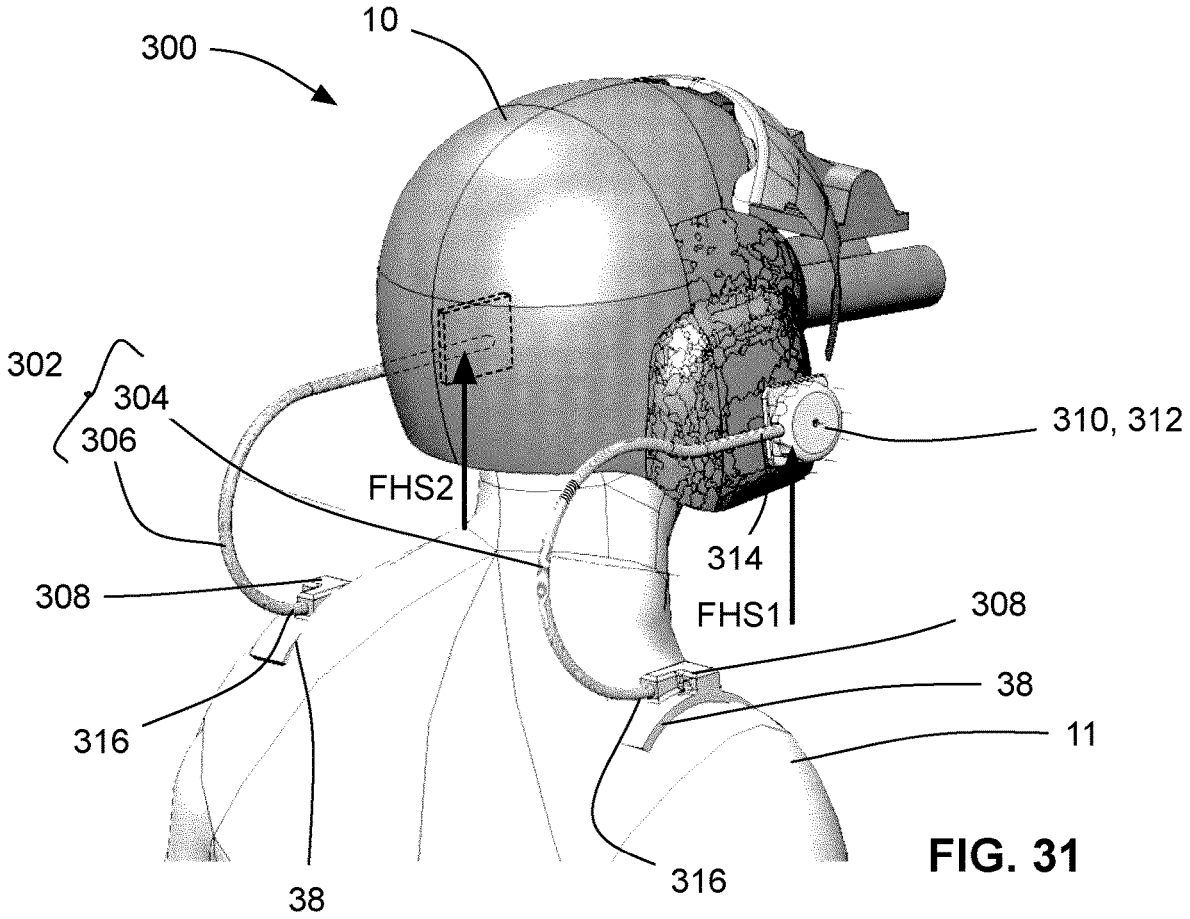
FIG. 31 is a perspective view of another embodiment of a system for mitigating stresses, which incorporates first and second lifters.
Figure 31A:
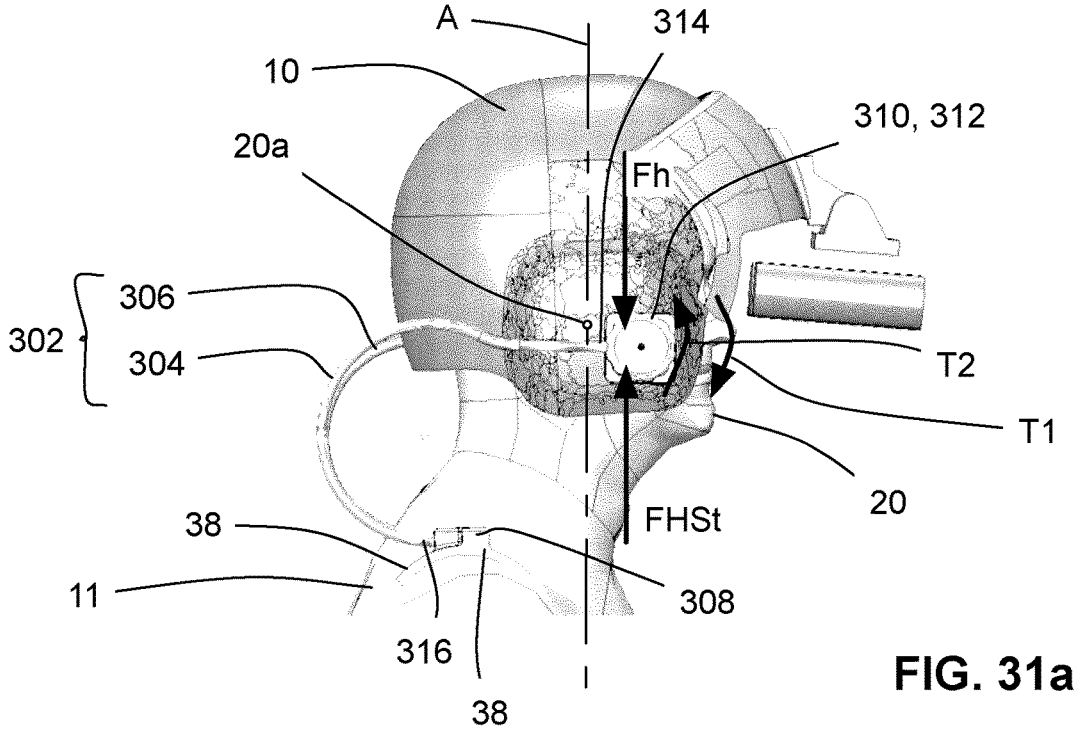
FIG. 31*a* is a side elevation view of the embodiment shown in FIG. 31, to illustrate the forces acting on the head of the wearer.

Reference is made to FIG. 31, which shows another embodiment of a stress mitigation system 300. The stress mitigation system 300 differs from the other systems described herein in the sense that the stress mitigation system 300 applies a force that lifts the head 20 of the wearer 11 to counteract the torque applied by the loads such as the night vision goggles and also to counteract the forces applied by the loads such as the night vision goggles 14.

The system 300 includes a flexible elongate connector arrangement 302 that is connectable between the headgear 10 and a bodywear member 38 configured for wearing on a body of the wearer 11. In the example shown in FIG. 31, the flexible elongate connector arrangement 302 includes first and second flexible elongate connectors 304 and 306, each of which extends between a body mount member 308 on a bodywear member 38, and a headgear mount member 310 on the headgear 10. At at least one of the body mount member 308 and the headgear mount member 310, there is provided a lifting force adjustment device 312.

Each flexible elongate connector 304 and 306 may be an elongate semi-rigid member that is bendable but that has a restoring force associated with bending flexure. An example of a suitable connector 304 or 306 is an elongate helical spring that extends along a generally C-shaped path between a first end 314 at the headgear mount member 310 and a second end 316 at the bodywear mount member 308. The connectors 304 and 306 apply lifting forces FHS1 and FHS2 at the headgear mount members 310 that are generated from the restoring force in the connectors 304 and 306 which urge the connectors 304 and 306 towards a straight (i.e. non-C-shaped) configuration. Another example of a connector 304 or 306 would be a semi-rigid elastomeric member, or a metallic ribbon member.

The lifting force adjustment device 312 includes a base 318, an end connector 320 that is configured to receive the first end 314 of the associated elongate flexible semi-rigid connector 304 or 306, and a position adjustment mechanism 321 that permits adjustment of the position of the end connector 320 relative to the base 318 so as to adjust the amount of flexure (and therefore restoring force, and therefore lifting force) is generated by the connector 304 or 306. The amount of flexure, in the embodiment shown in FIG. 31, may be directly related to the overall bend angle that is present in the connector 304 or 306.

Figure 32:
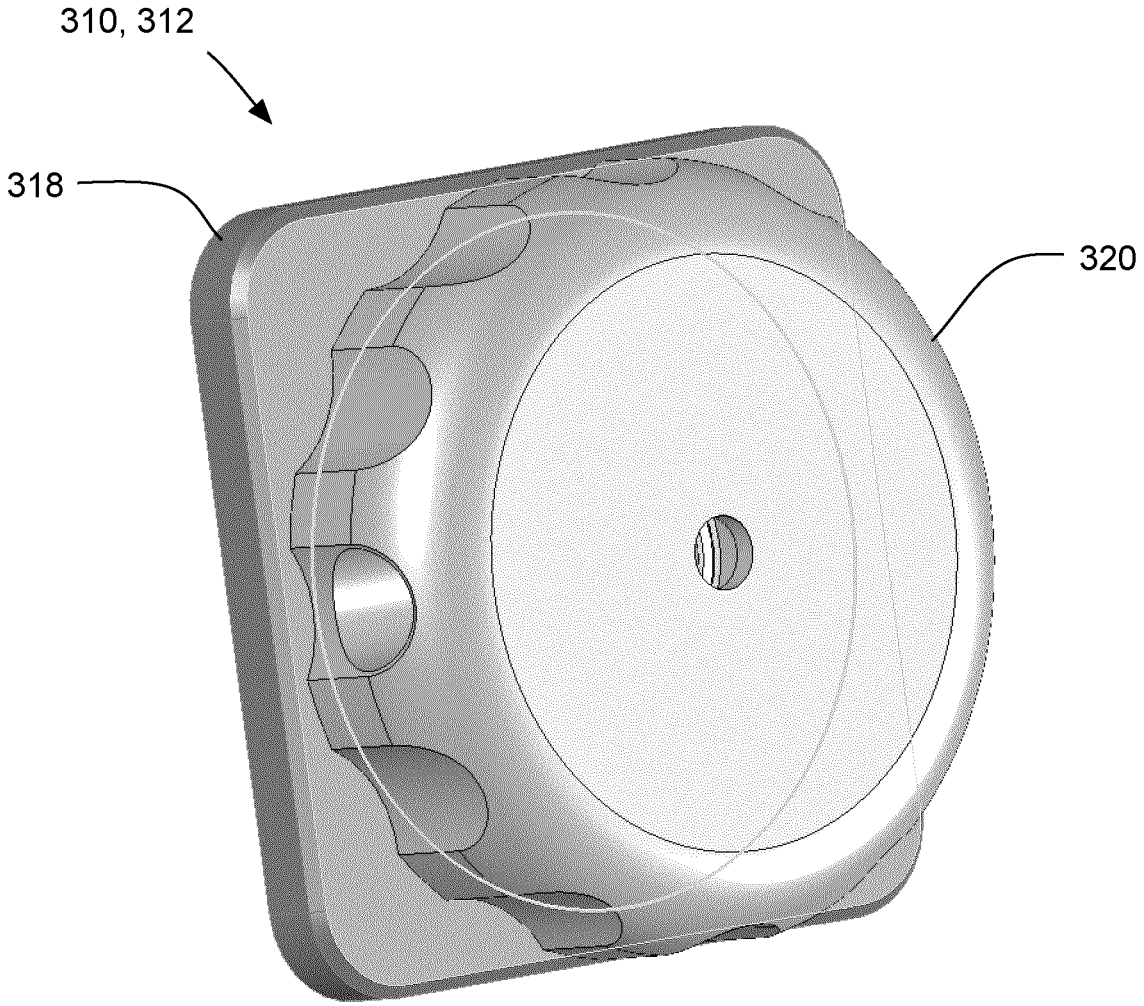
FIG. 32 is a perspective view of a preload adjustment device that is part of the system shown in FIG. 31.
Figure 33:
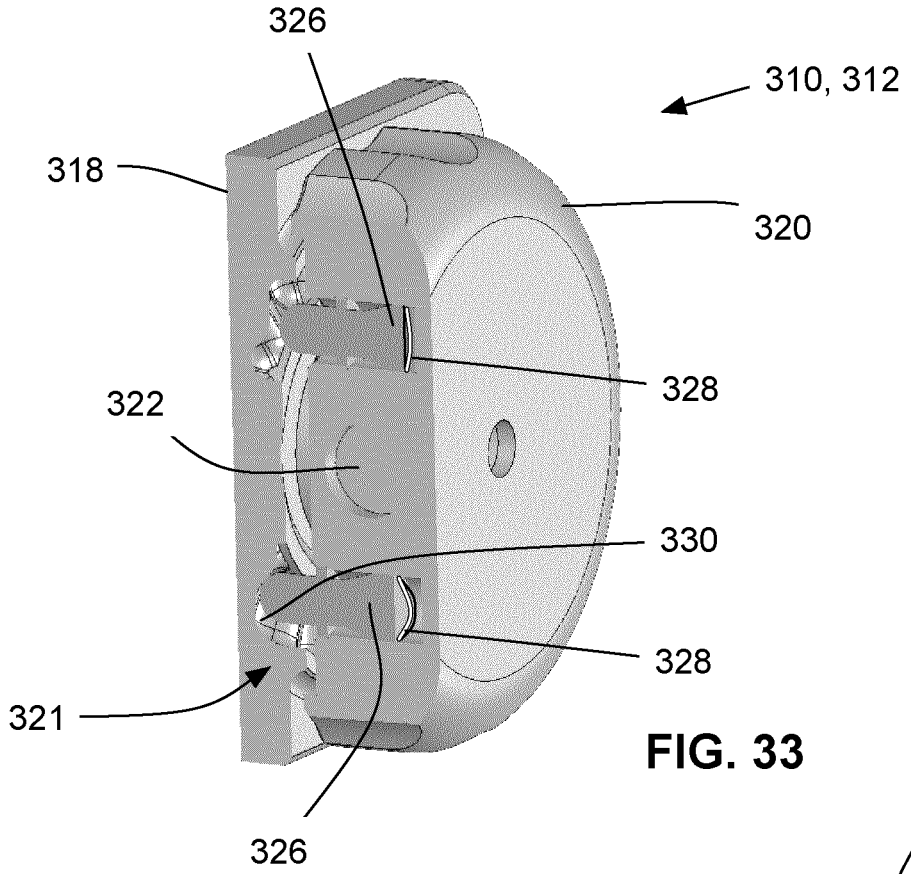
FIG. 33 is a sectional perspective view of the preload adjustment device shown in FIG. 32.
Figure 34:
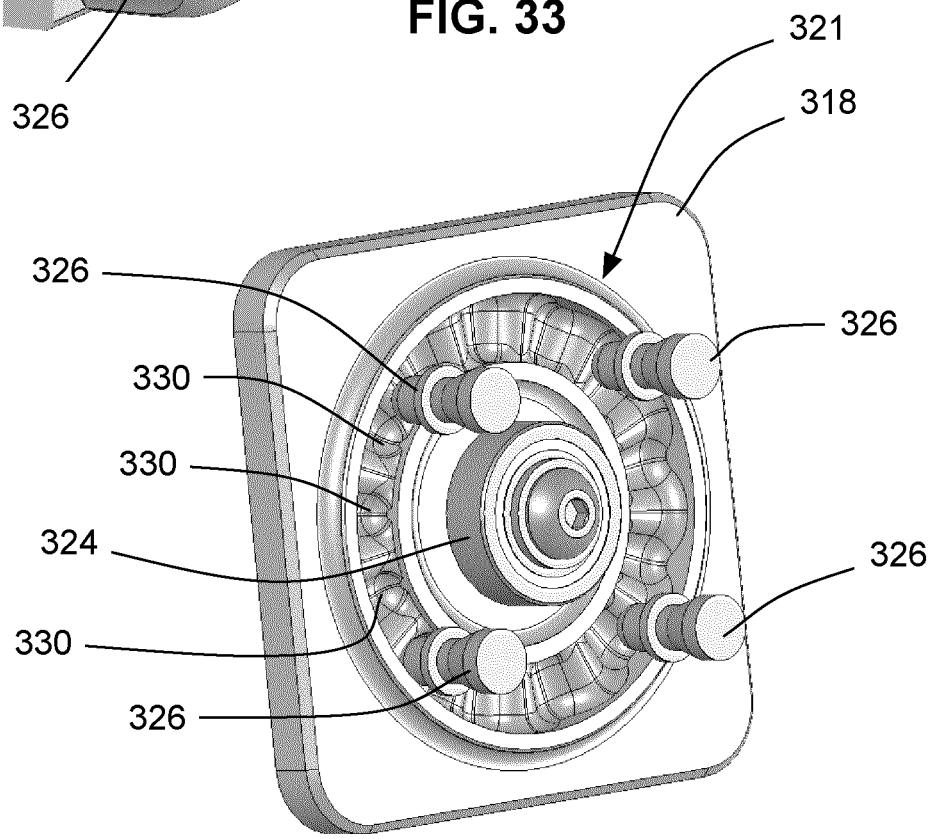
FIG. 34 is a perspective view of the preload adjustment device shown in FIG. 32 with a knob removed.

As shown in FIG. 31, the base 318 may mount fixedly or removably to the headgear 10, by way of adhesive, fasteners or any other suitable way. The end connector 318 may include an end receiving aperture 322 (FIGS. 32 and 33) that is sized to snugly receive the first end 314 of the associated connector 304 or 306. The end connector 320 is rotatable about a shaft 324 on the base 318. A plurality of spring biased ball plungers 326 (e.g. spring biased by Belleville washers 328) extend from the end connector 320 into detents 330 provided on the base 318 to releasably hold the end connector 318 at a selected orientation on the base 318, so as to cause a selected amount of angular flexure of the associated connector 304 or 306. Alternatively any other suitable position adjustment mechanism may be used.

It will be noted that the headgear 10 described above are but an example of the type of headgear that could benefit from any of the stress mitigation systems described herein. For example, other types of headgear that could benefit from such systems include virtual reality headgear, surgical headgear that include an eyepiece for magnifying an image and illuminating an area of a patient for the surgeon, or a safety helmet with a video camera mounted on it, such as those used by mountain bikers, or motorcyclists.

In the embodiment shown in FIGS. 31-34, the connectors 304 and 306 are configured to apply a force at a point forward of the center of gravity of the headgear so as to apply a torque that is opposite to the torque applied by the offset load urging the head of the wearer 11 to tilt forward and downwards. It will, however, be appreciated that the offset load could be positioned in some embodiments, in a position in which they apply a torque urging the wearer's head 11 to pivot upwards. In such cases, the connectors 304 and 306 may be configured to exert a lifting force rearward of the center of gravity of the headgear 10 so that the lifting force applies a torque that opposes the torque generated by the offset load.

Reference is made to FIGS. 35-39, which show a tensioning device 400 that could be used as part of the stress mitigation system 250 instead of the tensioning device 252 (FIG. 25). The tensioning device 400 may be similar to the tensioning device 252 shown in FIG. 25, but includes a tension adjustment mechanism that permits adjustment of the tension in the first and second cables 258 and 260.

Figure 35:
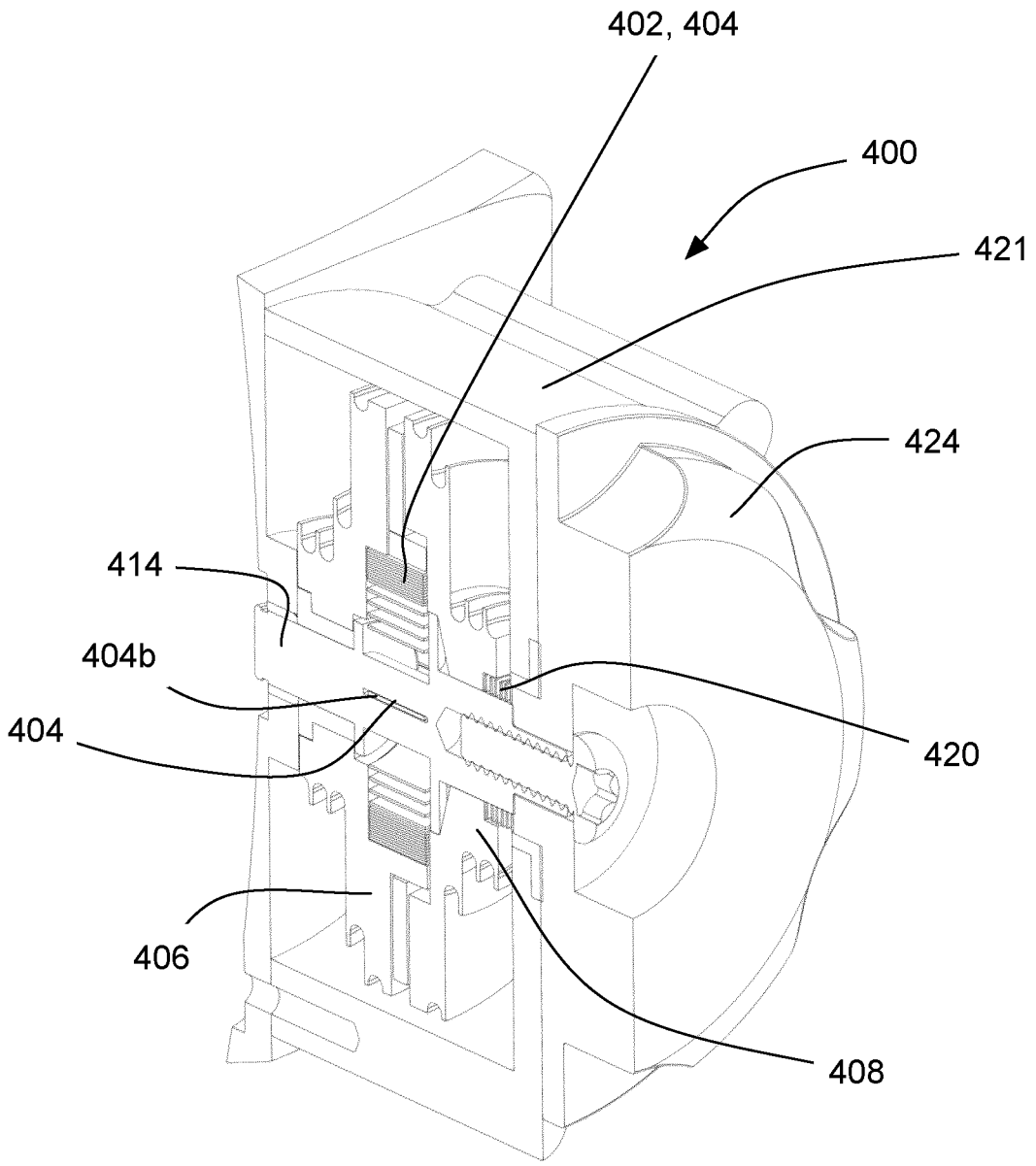
FIG. 35 is a sectional perspective view of an alternative tensioning device for use with the stress mitigation system shown in FIG. 25.

The tensioning device 400 maintains tension in the first and second cables 258 and 260 by means of a biasing member 402 that may be similar to the biasing member 272 (and which may be a clock spring 404). Two spools are shown in FIG. 35 at 406 and 408, and may be similar to the spools 254 and 256 in FIG. 26. The spools 406 and 408 are shown to face away from one another in FIG. 35, however it is possible in some embodiments for the spools 406 and 408 to face towards one another, while still keeping the clock spring 404 between them.

The clock spring 404 in the embodiment in FIGS. 35-39 is connected at its first end 404*a* to a wall 410 (by passing through a radial slot 412 (FIG. 36) in the wall 410) which is part of the first spool 406, and is connected at its second end 404*b* to a shaft 414 (e.g. via a slot 416 (FIG. 35) in the shaft 414). The shaft 414, in the embodiment shown in FIGS. 35-39 is separate from the second spool 408 but is releasably connectable to the second spool 408. A plurality of depressions 416 that are on one of the shaft 414 and the second spool 408 mesh with at least one tooth 418 (FIG. 37) on the other of the shaft 414 and the second spool 408 to lock the shaft 414 and the second spool 408 rotationally with one another. In the embodiment shown the depressions 416 are on the shaft 414 and there are a plurality of teeth 418 on the second spool 408.

A spool locking biasing member, shown at 420 in FIG. 35, biases the second spool 408 and the shaft 414 into engagement with one another such that the depressions and teeth 416 and 418 mesh with one another. The biasing member 420 may be any suitable type of biasing member such as a helical compression spring that has a first end that abuts a tensioning device housing 421 and a second end that abuts the second spool 408.

Figure 39:
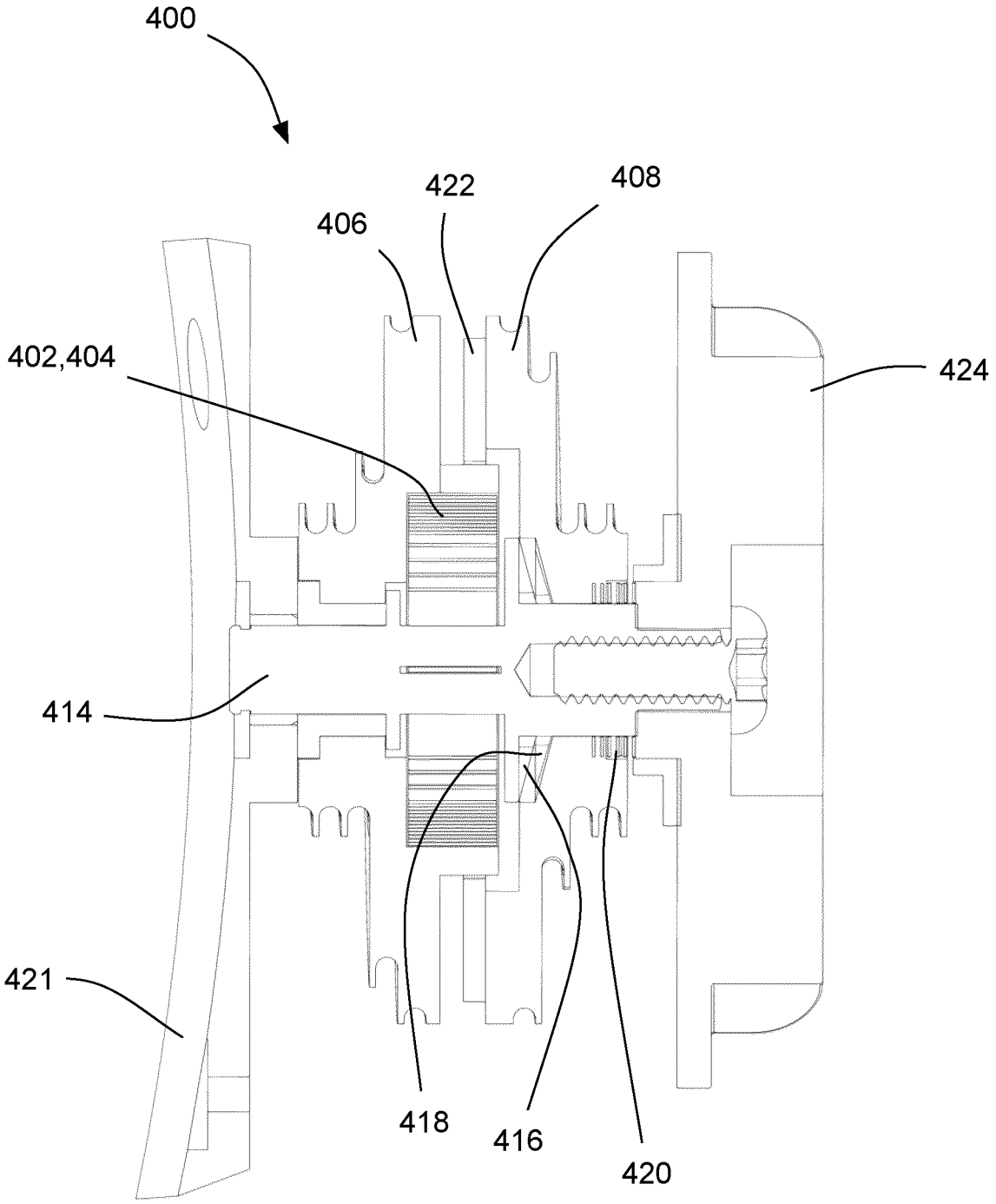
FIG. 39 is a sectional elevation view of the tensioning device shown in FIG. 35, with a second spool rotationally disconnected from a shaft.

When it is desired to adjust the tension in the cables 258 and 260, the wearer 11 can move a separator plate 422 to remove the second spool 408 from rotational engagement with the shaft 414 (FIG. 39). When the second spool 408 is rotationally disconnected from the shaft 414, the shaft 414 is now free to be rotated relative to the second spool 408. Thus, the wearer (not shown in FIG. 35) can rotate the shaft 414 using a handle 424 that is connected thereto, so as to change the amount of preload in the clock spring 404, since the shaft 414 has the second end 404*b* of the clock spring 404 connected thereto. Once the desired amount of preload exists in the clock spring 404, the wearer can release the separator plate 422, thereby permitting the biasing member 420 to bring the second spool 408 back into engagement with the shaft 414 to lock them together rotationally.

Put another way, the second spool 408 is positionable in a first position (FIG. 35) in which it is rotationally locked with the shaft 414 and therefore with the second end 404*b* of the clock spring 404, and a second position (FIG. 39) in which it is rotationally disconnected with the shaft 414 and therefore with the second end 404*b* of the clock spring 404.

While a shaft 414 is provided as the element that is engaged with the second end 404*b* of the clock spring 404 and that is the intermediate member between the clock spring 404 and the second spool 408, it will be understood that any other suitable member may act as an intermediate member between the clock spring 404 and the second spool 408 and may receive the second end 404*b* of the clock spring 404.

Figure 36:
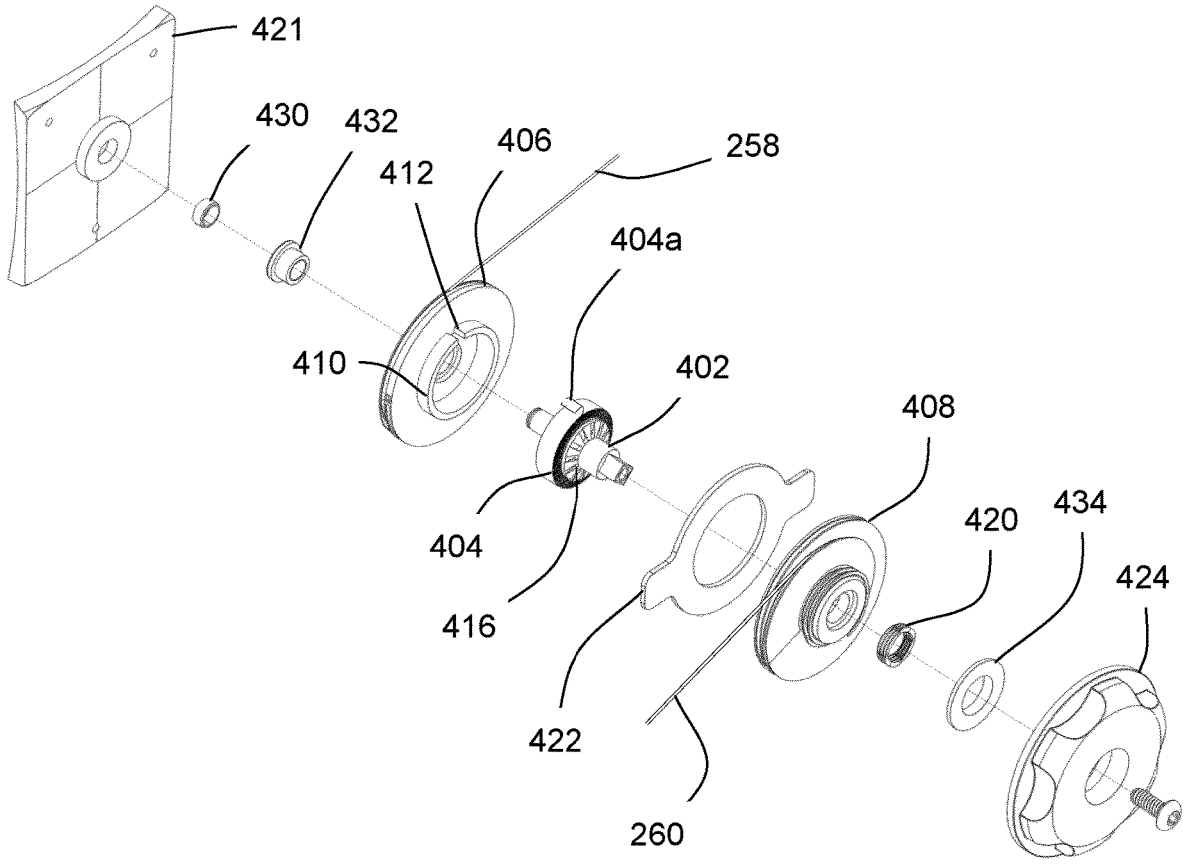
FIG. 36 is an exploded perspective view of the alternative tensioning device shown in FIG. 35.
Figure 37:
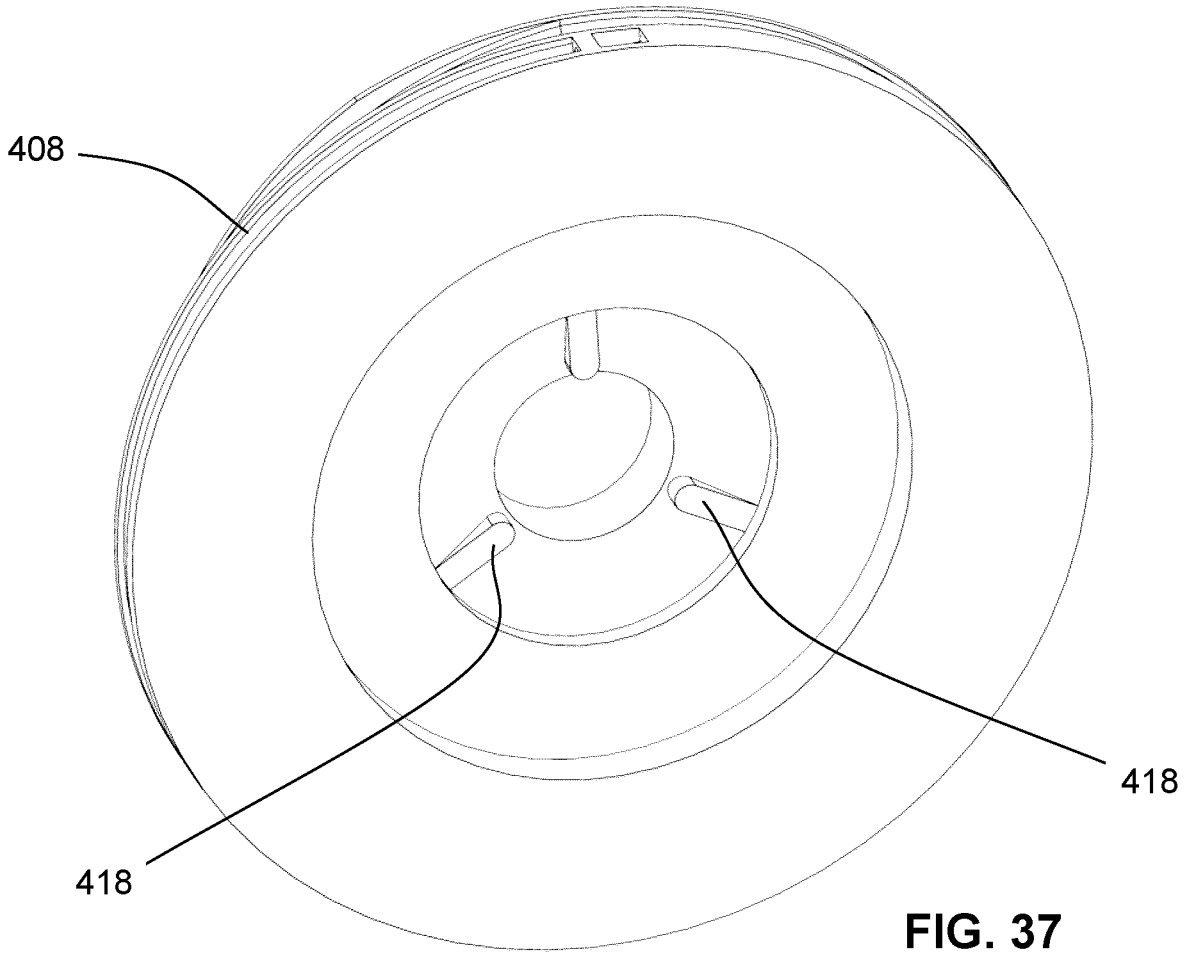
FIG. 37 is a perspective view of a spool that is part of the tensioning device shown in FIG. 35.
Figure 38:
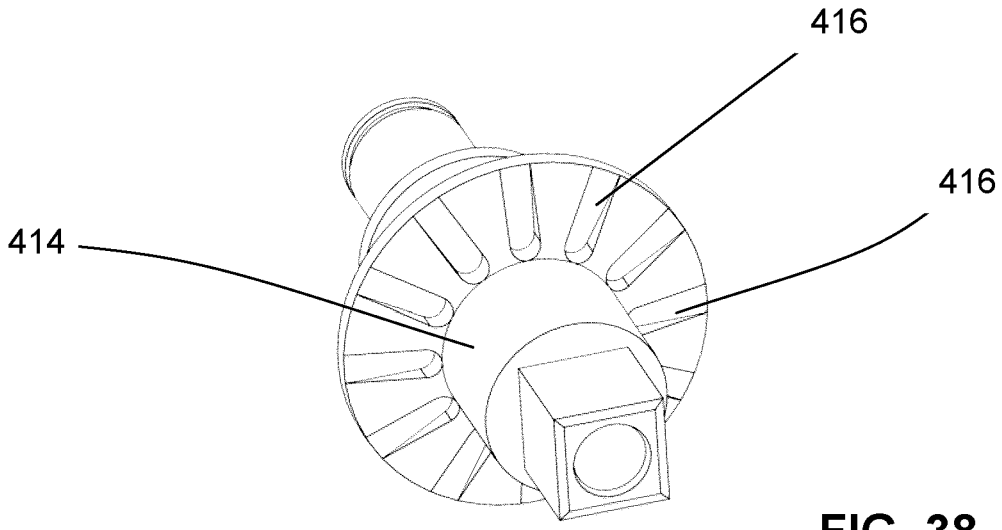
FIG. 38 is a perspective view of a shaft that is part of the tensioning device shown in FIG. 35.

As can be seen in FIG. 36, bushings 430 and 432 and a thrust member 434 are provided to support the shaft 414 for rotation relative to the housing 421, the first spool 406 relative to the shaft, and support the end of the biasing member 420

Figure 40:
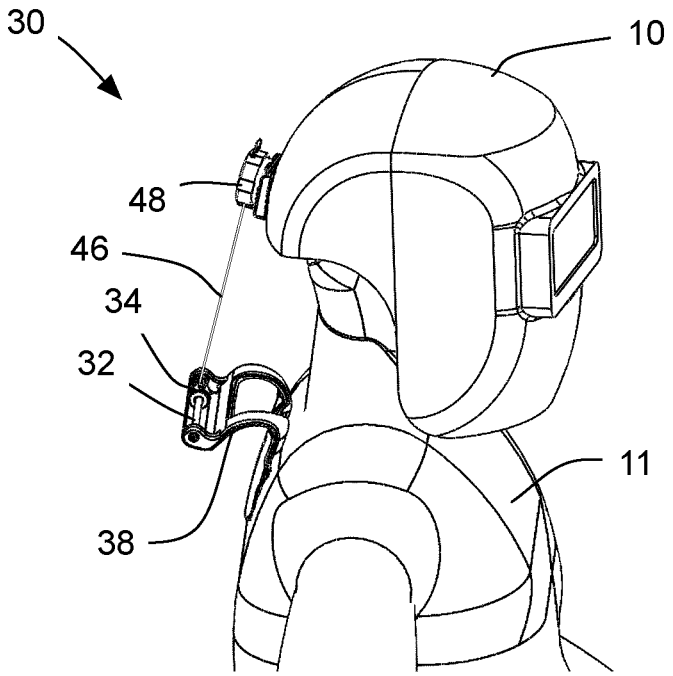
FIG. 40 is a perspective view of a wearer with the stress mitigation system shown in FIG. 2 on a welder's helmet.
Figure 41:
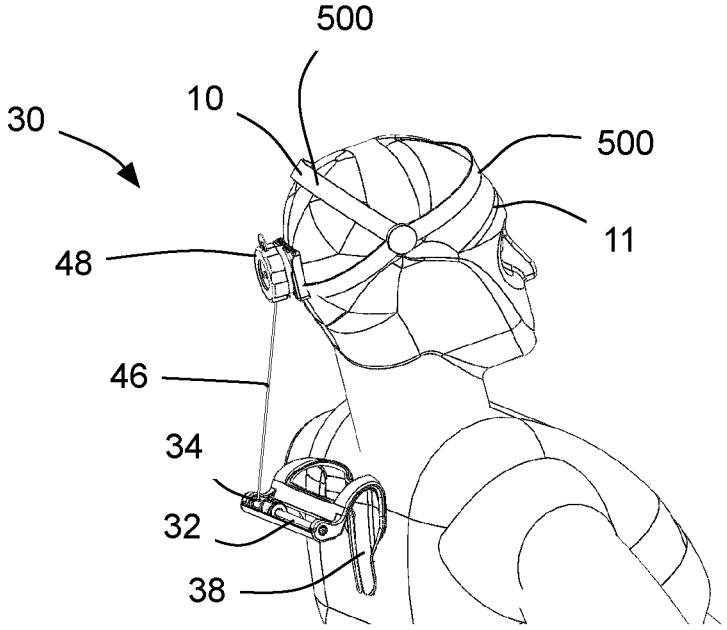
FIG. 41 is a perspective view of a person with the stress mitigation system shown in FIG. 2, with a headgear.

Reference is made to FIGS. 40 and 41, which show other applications for stress mitigation systems described herein. For example, in FIG. 40, the stress mitigation system 30 is shown being used to control stresses incurred when wearing a welder's helmet (i.e. when the headgear 10 is a welder's helmet). In FIG. 41, the stress mitigation system 30 is shown being used with a headgear 10 that includes straps and the like but where there is no helmet. An example of such a headgear 10 could be used in conjunction with virtual reality goggles, where a helmet is not necessary. Another example would be when a welder's mask is used instead of a welder's helmet. Yet another example would be a surgeon who is wearing lead-lined glasses during certain types of surgery to protect against radiation exposure. It will be understood that many other applications exist for the stress mitigation systems shown herein.

Also, in relation to FIG. 41, there are situations in which a person may incur stress in their neck muscles even when they are not wearing a headgear with offset-weighted items on it. For example, in situations where a person spends long periods of time with their head facing downwards, their head itself is essentially held in cantilever to their body and stresses the neck muscles of the person. Some examples of such situations include: a bicycle rider whose body posture can be tilted forward for long periods, a gardener who is generally looking downwardly for long periods to carry out his/her work, a person who is lying on their front and either looking forward or looking downward (such as the aforementioned helicopter engineer, regardless of whether or not they are wearing a helmet or goggles or any other head-mounted device), or a disabled or sick person who may spend long periods sitting with their head tilted forward because they are too weak or otherwise unable to hold their head upright. In such situations it may be advantageous to provide a headgear, such as the headgear 10 shown in FIG. 41 (and which may comprise simple straps shown at 500) which permits the mounting of the end 46*b* of the flexible elongate connector 46 to the wearer's head 11, (indirectly via the tensioning device 48) or which permits the mounting of any of the other embodiments described herein to the wearer's head, as appropriate. Thus, in an embodiment, a stress mitigation system is provided for mitigating stresses in neck muscles of a person, comprising: a headgear (e.g. headgear 10 shown in FIG. 41), a track (e.g. track 32 shown in FIG. 41), a shuttle (e.g. shuttle 34 shown in FIG. 41), and a flexible elongate connector (e.g. cable 46 shown in FIG. 41). The headgear is configured to mount to the head 11 of the person. The track is mounted to one of the headgear and a bodywear member (e.g. bodywear member 38 shown in FIG. 41) that is configured for wearing on a body of the person. The track extends generally laterally. The shuttle is movable along the track. The flexible elongate connector is configured to connect between the shuttle and the other of the headgear and the bodywear member. In a selected position, the flexible elongate connector is biased so as to apply a torque on the headgear in a selected torque direction. When the head of the wearer pivots about a generally longitudinal axis, the shuttle is movable laterally along the track so as to maintain the flexible elongate connector in a substantially longitudinal orientation.

In any of the embodiments described above, it is possible that some form of headgear could be provided as part of the stress mitigation system, that connects to, or that may be separate from, any headgear that a person may be wearing that has an offset-weighted item on it.

Figure 42:
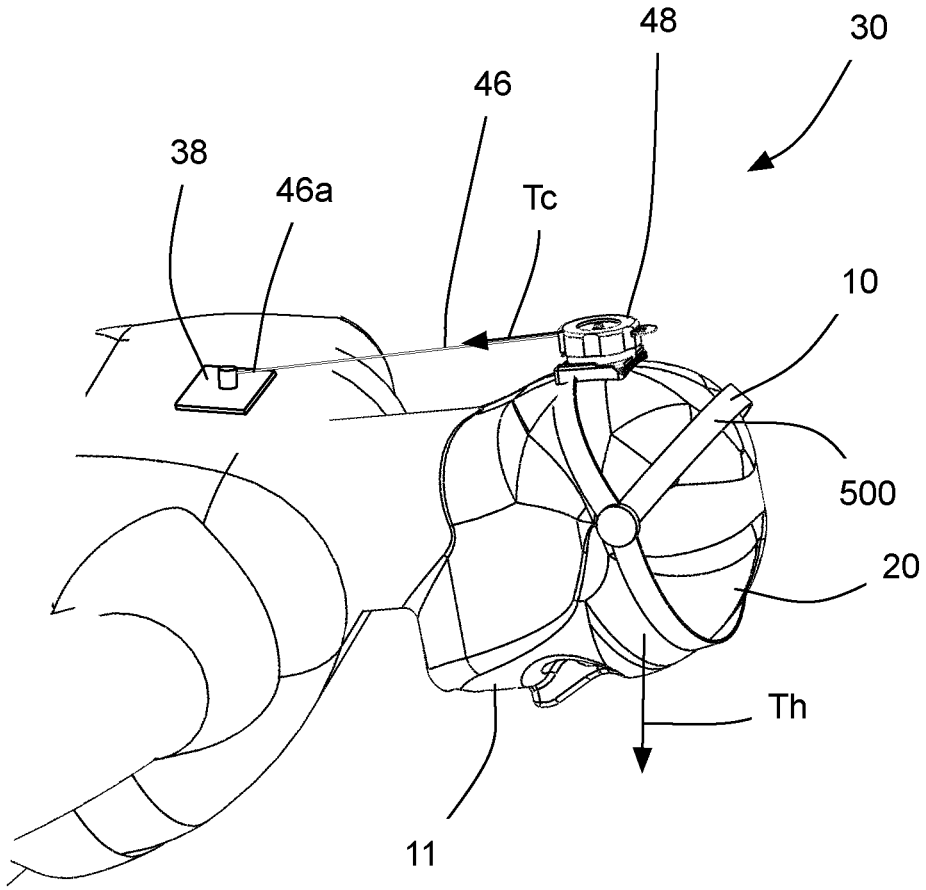
FIG. 42 is a perspective view of a person with another embodiment of a stress mitigation system.

For example, in an embodiment, a stress mitigation system could be provided for mitigating stresses in neck muscles of a person, that is similar to the embodiment shown in FIG. 41, but wherein the track 32 and shuttle 34 are omitted, and the first end 46*a* of the cable 46 is mounted directly to the bodywear member 38 such that the first end of the cable 46 is fixed in position laterally. An example of such an embodiment is shown in FIG. 42. In the embodiment in FIG. 42, the stress mitigation system includes: the headgear 10, the flexible elongate connector 46 and a tensioning device 48 that includes a take-up member (e.g. the spool 54 shown in FIGS. 14*a* and 14*b*) that is configured for taking up and paying out the flexible elongate member 46 and is biased so as to apply tension to the flexible elongate connector 46. The headgear 10 is configured to mount to the head of the person. The flexible elongate connector 46 is configured to connect between the headgear 10 and the bodywear member 38. When the person is in a selected position, the flexible elongate connector 46 is biased so as to apply a selected torque on the headgear 10 in a selected torque direction. In the example shown in FIG. 42, the person's body is generally horizontal and the weight of their head 20 applies a torque Th on their head 11. The selected torque Tc from the flexible elongate connector 46 is applied in a selected direction that is opposed to the torque Th from the weight of the head 20 of the wearer 11 so as to counteract (partially or fully) the torque Th.

Throughout this disclosure, the use of a spool has been described as being used to take up and pay out some of the length of the cable 46 so that the effective length of the cable 46 could adjust as needed based on the position of the person's head. It will be understood, however, that the spool is but one example of a take-up member that could be used to take up and pay out some length of the cable 46. Any other suitable take-up member could alternatively be used. For example, a block-and-tackle (not shown) that includes at least two pulleys, wherein one of the pulleys is biased by a compression spring away from the other pulley could be used to take up and pay out some length of the cable 46 as needed. The compression spring would act as a biasing member to maintain tension in the cable 46.

Those skilled in the art will understand that a variety of modifications may be effected to the embodiments described herein without departing from the scope of the appended claims.

The invention claimed is:

1. A stress mitigation system for a headgear so as to mitigate stresses in a wearer of the headgear, wherein the headgear is configured to apply a load on the wearer that is offset from a center of gravity of a head of the wearer so as to apply a first torque in a first torque direction on the head of the wearer, the stress mitigation system comprising:

a bodywear member configured for wearing on a body of the wearer;

a flexible elongate connector that is configured to connect between the headgear and the bodywear member, a biasing member that is positioned away from a neutral position for the biasing member and is urged towards the neutral position, thereby applying a biasing force on the flexible elongate connector when the flexible elongate connector is stationary, the biasing force generating a second torque on the headgear in a second torque direction that is generally opposite to the first torque direction when the wearer is upright.

2. A stress mitigation system as claimed in claim 1, further comprising:

a track that is mounted to one of the headgear and the bodywear member, wherein the track extends generally laterally;

a shuttle that is movable along the track;

wherein the flexible elongate connector is configured to connect between the shuttle and the other of the headgear and the bodywear member, wherein, when the head of the wearer pivots about a generally vertical axis, the shuttle is movable laterally along the track so as to maintain the flexible elongate connector in a substantially vertical orientation.

3. A stress mitigation system as claimed in claim 1, wherein the track is mounted to the bodywear member.

4. A stress mitigation system as claimed in claim 1, wherein the track has a generally circular cross-sectional shape.

5. A stress mitigation system as claimed in claim 4, wherein the shuttle body has a bushing that defines a generally cylindrical shuttle aperture that receives the track therethrough.

6. A stress mitigation system as claimed in claim 5, wherein the shuttle aperture has a geometric center, wherein the shuttle further includes a pivot member pivotably connected to the shuttle body for pivotal movement about a pivot member axis that passes proximate to the geometric centre of the shuttle aperture, and wherein the flexible elongate connector has a first end that pivotally connects to the pivot member such that the pivot member transmits tension force from the flexible elongate connector to the shuttle body proximate to the geometric centre of the shuttle aperture.

7. A stress mitigation system as claimed in claim 1, further comprising a tensioning device that tensions the flexible elongate connector.

8. A stress mitigation system as claimed in claim 7, wherein the tensioning device includes a flexible elongate connector biasing member that is a clock spring.

9. A stress mitigation system as claimed in claim 8, wherein the tensioning device includes a tension adjustment mechanism that permits adjustment of a first end of the clock spring so as to adjust a preload in the clock spring.

10. A stress mitigation system as claimed in claim 8, wherein the tensioning device includes a spool to which the flexible elongate connector is connected.

11. A stress mitigation system as claimed in claim 10, wherein the tensioning device is releasably connected to the headgear.

12. A stress mitigation system as claimed in claim 10, wherein the flexible elongate connector is releasable from at least a portion of the shuttle.

13. A stress mitigation system as claimed in claim 6, wherein the pivot member has a first limit surface and the shuttle body has a first limit surface, and wherein a selected tension in the flexible elongate connector over a selected range of angle causes the first pivot surfaces on the pivot member and the shuttle body to engage one another and to act as a fulcrum to cause the pivot member to release from the shuttle body.

14. A stress mitigation system for mitigating stresses in neck muscles of a person, comprising:

a headgear configured to mount to the head of the person, wherein the headgear is configured to apply a first torque in a first torque direction on the head of the wearer;

a bodywear member configured for wearing on a body of the person;

a flexible elongate connector that is configured to connect between the headgear and the bodywear member; and a biasing member that is positioned away from a neutral position for the biasing member and is urged towards the neutral position, thereby applying a biasing force on the flexible elongate connector when the flexible elongate connector is stationary, the biasing force generating a second torque on the headgear in a second torque direction that is generally opposite to the first torque direction when the wearer is upright.

15. A stress mitigation system as claimed in claim 14, further comprising:

a track that is mounted to one of the headgear and the bodywear member, wherein the track extends generally laterally;

a shuttle that is movable along the track;

wherein the flexible elongate connector is configured to connect between the shuttle and the other of the headgear and the bodywear member, wherein, when the head of the wearer pivots about a generally longitudinal axis, the shuttle is movable laterally along the track so as to maintain the flexible elongate connector in a substantially longitudinal orientation.

* * * * *